US011053663B2

(12) United States Patent
Kean et al.

(10) Patent No.: US 11,053,663 B2
(45) Date of Patent: Jul. 6, 2021

(54) AGRICULTURAL MACHINE HAVING A PROCESSOR CONFIGURED TO TRACK A POSITION OF A DRAFT FRAME

(71) Applicant: Deere & Company, Moline, IL (US)

(72) Inventors: Michael G. Kean, Dubuque, IA (US); Michael D. Peat, Dubuque, IA (US); Todd F. Velde, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 6 days.

(21) Appl. No.: 16/130,743

(22) Filed: Sep. 13, 2018

(65) Prior Publication Data

US 2020/0087888 A1 Mar. 19, 2020

(51) Int. Cl.

| | |
|---|---|
| ***E02F 3/84*** | (2006.01) |
| ***E02F 3/76*** | (2006.01) |
| ***E02F 9/20*** | (2006.01) |
| ***E02F 9/00*** | (2006.01) |

(52) U.S. Cl.

CPC ..... *E02F 3/844* (2013.01); *E02F 3/7672* (2013.01); *E02F 9/006* (2013.01); *E02F 9/2037* (2013.01); *E02F 9/2041* (2013.01)

(58) Field of Classification Search

CPC ..... E02F 3/844; E02F 3/7672; E02F 9/006; E02F 9/2037; E02F 9/2041

USPC ..... 172/819

See application file for complete search history.

(56) References Cited

U.S. PATENT DOCUMENTS

| | | | | |
|---|---|---|---|---|
| 3,791,457 A | | 2/1974 | Hanser et al. | |
| 4,061,194 A | * | 12/1977 | McCanse | E02F 3/7627 172/260.5 |
| 4,084,644 A | * | 4/1978 | Cole et al. | E02F 3/764 172/719 |
| 4,156,466 A | * | 5/1979 | Caldwell | E02F 3/765 172/4.5 |
| 4,201,268 A | * | 5/1980 | Frisbee | E02F 3/7613 172/812 |
| 5,941,658 A | * | 8/1999 | Dahlinger et al. | E01C 19/008 172/4.5 |

(Continued)

FOREIGN PATENT DOCUMENTS

WO 2017061888 A1 4/2017

*Primary Examiner* — Tara Mayo-Pinnock

(74) *Attorney, Agent, or Firm* — Michael Best & Friedrich LLP

(57) ABSTRACT

A motor grader including a main frame, an operational frame movable relative to the main frame about a primary joint, and a plurality of hydraulic cylinders configured to adjust a position of the operational frame relative to the main frame, where each cylinder of the plurality of cylinders is movable between an extended position and a retracted position to adjust the length thereof. The motor grader further includes a processor configured to receive a signal indicating a desired cross slope of the operational frame, receive a signal identifying one of the plurality of cylinders as a lead cylinder, determine a desired position of the operational frame that achieves the desired cross slope of the operational frame, estimate a current position of the operational frame by monitoring a length of the lead cylinder, and adjust the position of the operational frame by controlling a follower cylinder of the plurality of cylinders to create the desired cross slope.

22 Claims, 15 Drawing Sheets

(56) References Cited

U.S. PATENT DOCUMENTS 6,028,524 A 2/2000 Hartman et al.
6,129,156 A 10/2000 Boast et al.
6,278,955 B1 8/2001 Hartman et al.
6,282,453 B1 8/2001 Lombardi
6,851,485 B2 2/2005 Maeda et al.
7,588,088 B2 9/2009 Zachman
7,647,983 B2 1/2010 Gharsalli
7,874,377 B1 1/2011 Graeve
8,103,417 B2 1/2012 Gharsalli et al.
8,746,362 B2 6/2014 Bindl et al.
9,328,479 B1 * 5/2016 Rausch et al. ..... E02F 3/845
9,458,581 B1 * 10/2016 Schaeding ..... E02F 9/2041
10,030,366 B2 7/2018 Tevis et al.
2001/0029417 A1 10/2001 Phelps
2008/0263912 A1 10/2008 Gharsalli et al.
2009/0056961 A1 * 3/2009 Gharsalli et al. ..... E02F 3/844 172/4.5
2010/0051301 A1 3/2010 Staade et al.
2012/0293316 A1 * 11/2012 Johnson et al. ..... E02F 9/2079 340/438
2013/0158818 A1 * 6/2013 Callaway ..... E02F 3/845 701/50
2013/0158819 A1 * 6/2013 Callaway ..... E02F 3/845 701/50
2014/0251648 A1 * 9/2014 Staade et al. ..... E02F 3/7668 172/796
2015/0240453 A1 * 8/2015 Jaliwala et al. ..... E02F 9/2041 701/50
2015/0330057 A1 * 11/2015 Faivre et al. ..... E02F 3/7618 701/50
2016/0208460 A1 7/2016 Kirsch
2016/0289916 A1 * 10/2016 Callaway et al. ..... E02F 3/844
2016/0319512 A1 * 11/2016 O'Neill et al. ..... E02F 3/844
2017/0002544 A1 * 1/2017 Fletcher et al. ..... E02F 3/3411
2017/0101762 A1 * 4/2017 Chaston et al. ..... E02F 3/844
2017/0114521 A1 * 4/2017 Wuisan et al. ..... E02F 3/765
2017/0114522 A1 * 4/2017 Maifield et al. ..... E02F 3/764
2017/0114523 A1 * 4/2017 Horstman et al. .... E02F 9/2004
2017/0130427 A1 * 5/2017 Metzger ..... E02F 9/2225
2017/0284067 A1 10/2017 Tevis et al.
2018/0016769 A1 1/2018 Omelchenko
2018/0106014 A1 4/2018 Horstman et al.

* cited by examiner

AGRICULTURAL MACHINE HAVING A PROCESSOR CONFIGURED TO TRACK A POSITION OF A DRAFT FRAME

FIELD OF THE DISCLOSURE

The present disclosure relates to agricultural machines, and specifically, to a method of tracking the position of a working implement of the agricultural machine.

BACKGROUND

Agricultural machines are often used to manipulate a surface (e.g., the ground) or to move raw materials (e.g., dirt, crop). For example, motor graders are used, among other things, to contour and smooth out the surface of a construction site. Generally, motor graders include a main frame, a draft frame, a circle frame, a tilt frame, and a working implement. The main frame supports an operator cabin and the motor of the vehicle. The working implement is used to manipulate a surface or to move raw materials. In the illustrated embodiment, the working implement is a blade capable of moving ground and dirt to create a desired surface contour. However, in other agricultural machines, the working implement may be a shovel or other tool capable of manipulating the ground or moving materials.

Operation of the draft frame, the circle frame, and the tilt frame control the movement of the blade to create the desired ground surface. In particular, the draft frame supports the circle frame, the tilt frame and the blade, and is capable of moving relative to the main frame. The circle frame supports the tilt frame and the blade, and is capable of rotating relative to the draft frame. The tilt frame supports the blade, and is capable of moving the blade relative to the circle frame.

Each of these operational frames (i.e., the draft frame, the circle frame, and the tilt frame) controls a different direction of movement and/or rotation of the blade. Accordingly, operation of the draft frame, the circle frame, and the tilt frame allow the blade to be adjusted between many different positions and orientations to shape the ground surface. Precisely controlling the blade can be a complex task, which requires an operator to operate the draft frame, the circle frame, and the tilt frame in order to position and move the blade. Tracking the position of the draft frame may improve or simplify the operation of the motor grader.

SUMMARY

In one embodiment, a motor grader includes a main frame, an operational frame movable relative to the main frame about a primary joint, and a plurality of hydraulic cylinders configured to adjust a position of the operational frame relative to the main frame, where each cylinder of the plurality of cylinders is movable between an extended position and a retracted position to adjust the length thereof. The plurality of cylinders are operatively connected such that movement of one cylinder of the plurality of cylinders causes movement of at least another cylinder of the plurality of cylinders. The motor grader further includes a processor configured to receive a signal corresponding to a parameter related to a length of a first cylinder of the plurality of cylinders, and estimate a position of the operational frame relative to the main frame based at least in part on the length of the first cylinder, where the processor estimates the position of the operational frame by executing an iterative mathematical model to solve for the position of the operational frame.

In another embodiment, a motor grader includes a main frame, an operational frame movable relative to the main frame about a primary joint, and a plurality of hydraulic cylinders configured to adjust a position of the operational frame relative to the main frame, where each cylinder of the plurality of cylinders is movable between an extended position and a retracted position to adjust the length thereof. The motor grader further includes a processor configured to receive a signal indicating a desired cross slope of the operational frame, receive a signal identifying one of the plurality of cylinders as a lead cylinder, determine a desired position of the operational frame that achieves the desired cross slope of the operational frame, estimate a current position of the operational frame by monitoring a length of the lead cylinder, and adjust the position of the operational frame by controlling a follower cylinder of the plurality of cylinders to create the desired cross slope.

In yet another embodiment, a motor grader includes a main frame, an operational frame movable relative to the main frame about a primary joint, and a plurality of hydraulic cylinders configured to adjust a position of the operational frame relative to the main frame, where each cylinder of the plurality of cylinders is movable between an extended position and a retracted position to adjust the length thereof. The motor grader includes a plurality of sensors, where each sensor of the plurality of sensors is associated with one cylinder of the plurality of cylinders, and where each sensor is configured to sense a parameter relating to the length of the corresponding cylinder. The motor grader further includes a processor configured to receive a signal corresponding to a parameter related to a length of a first cylinder of the plurality of cylinders, estimate a position of the operational frame based on the received signal, estimate a velocity of the operational frame based on the received signal, and adjust the operational frame by executing a valve command to the to a second cylinder of the plurality of cylinders.

Other aspects will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially," "about," "approximately," etc. are understood by those of ordinary skill to refer to reasonable ranges outside of the given value, for example, general tolerances associated with manufacturing, assembly, and use of the described embodiments.

In addition, it should be noted that a plurality of hardware and software based devices, as well as a plurality of different structural components may be utilized to implement embodiments described herein. In addition, it should be understood that embodiments described herein may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of embodiments described herein may be implemented in software (for example, stored on non-transitory computer-readable medium) executable by one or more processors. As such, it should be noted that a plurality of hardware and software based devices, as well as a plurality of different structural components may be utilized to implement the described embodiments. For example, "controller" and "control unit" described in the specification may include one or more electronic processors, one or more memory modules including non-transitory computer-readable medium, one or more input/output interfaces, and various connections (for example, a system bus) connecting the components.

DETAILED DESCRIPTION

Figure 1:
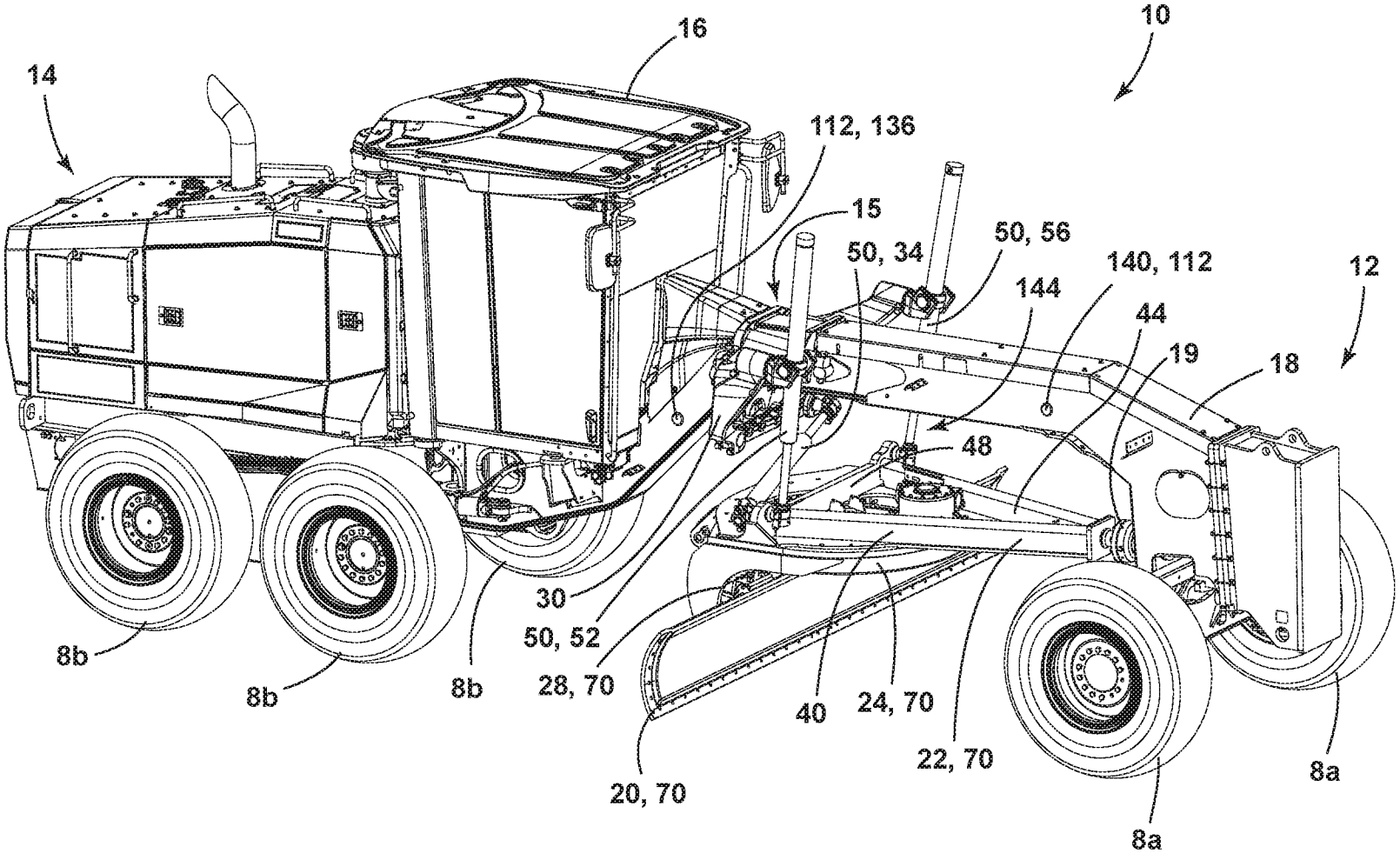
FIG. 1 is a perspective view of a motor grader according to one embodiment.
Figure 2:
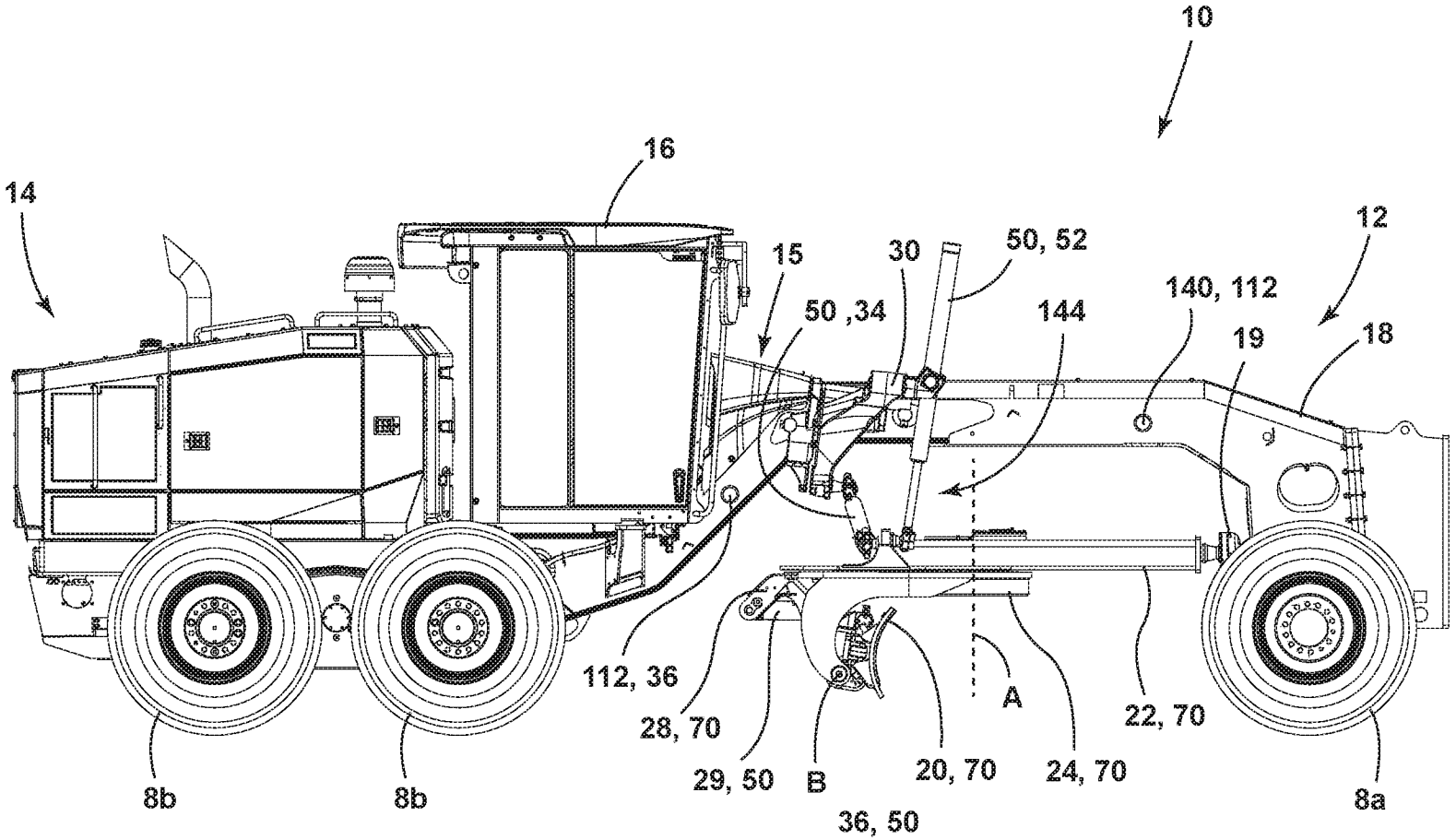
FIG. 2 is a side view of the motor grader of FIG. 1.
Figure 3:
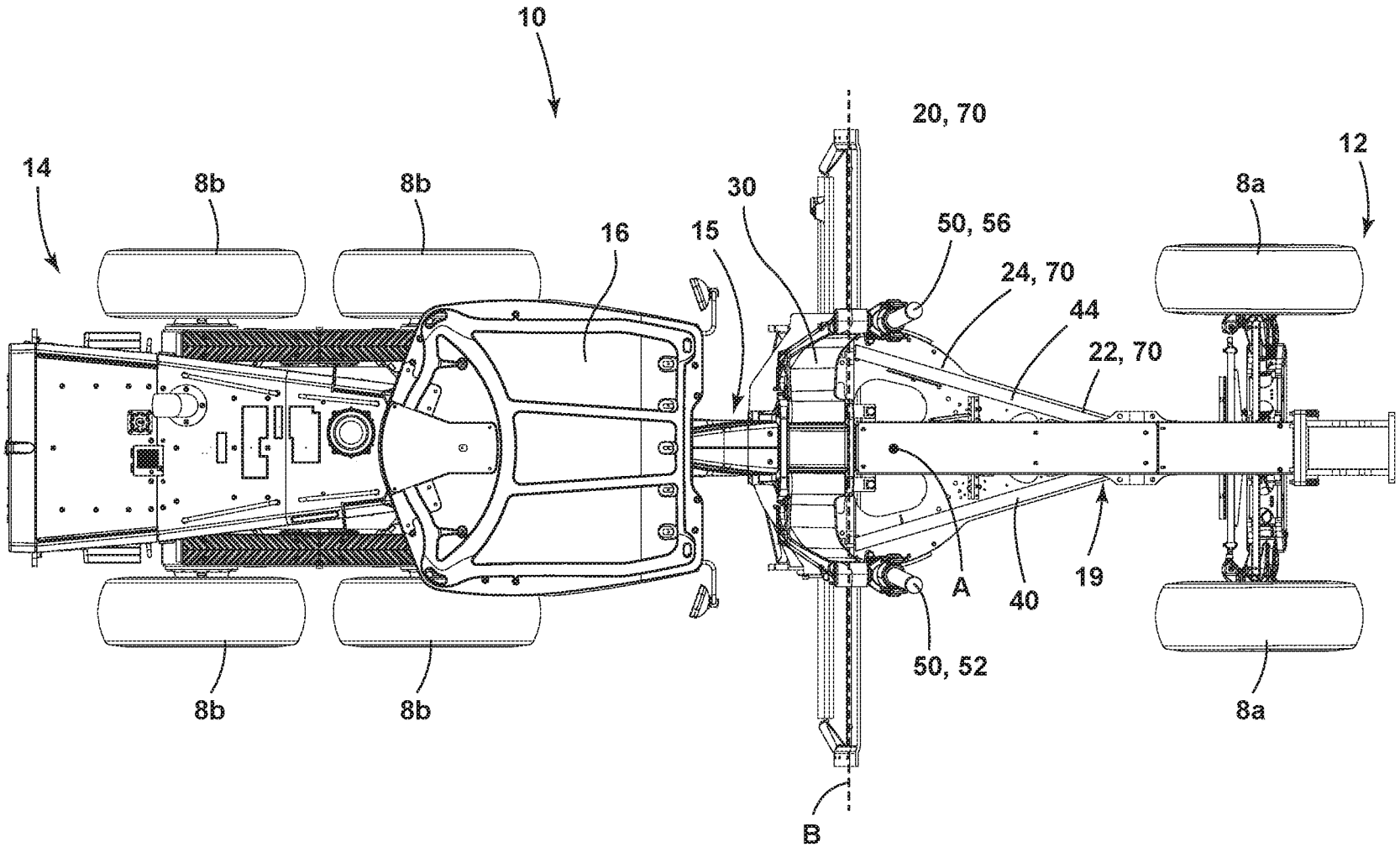
FIG. 3 is a top view of the motor grader of FIG. 1.

FIGS. 1-3 illustrate a work vehicle, and specifically, a motor grader 10. It should be understood that the illustrated motor grader 10 is provided as an example and embodiments described herein may be used with motor graders 10 or other work vehicles that differ from the motor grader 10 illustrated in FIGS. 1-3.

The illustrated motor grader 10 has front and rear sections 12, 14. The front and rear sections 12, 14 are articulated relative to one another at an articulation joint 15 for steering of the motor grader 10. The motor grader 10 has six ground-engaging wheels 8. The front section 12 has two wheels 8*a*, a left front wheel 8*a* and a right front wheel 8*a*. The rear section 14 has four wheels 8*b*, two left rear wheels 8*b* arranged in a tandem and two right rear wheels 8*b* arranged in a tandem. The rear section 14 includes an internal combustion engine (e.g., diesel engine) to power the motor grader 10. The front section 12 has an operator's station 16 from which a human operator can control the motor grader 10. The operator's station 16 is supported on a main frame 18 of the front section 12.

The front section 12 of the motor grader 10 supports a working implement, such as a blade 20, which is mounted to a main frame 18 of the front section 12. The blade 20 is configured for moving dirt or other material in order to create a desired contour of the ground surface. The blade 20 is mounted to the main frame 18 for movement in a number of directions, including translational movement, roll, pitch, and yaw. The blade 20 is mounted to the main frame 18 and movable relative to the main frame 18 via a draft frame 22, a circle frame 24, and a tilt frame 28. In particular, the blade 20 is coupled to the tilt frame 28. The tilt frame 28 is supported by the circle frame 24, which is in turn, supported below the draft frame 22.

Figure 4:
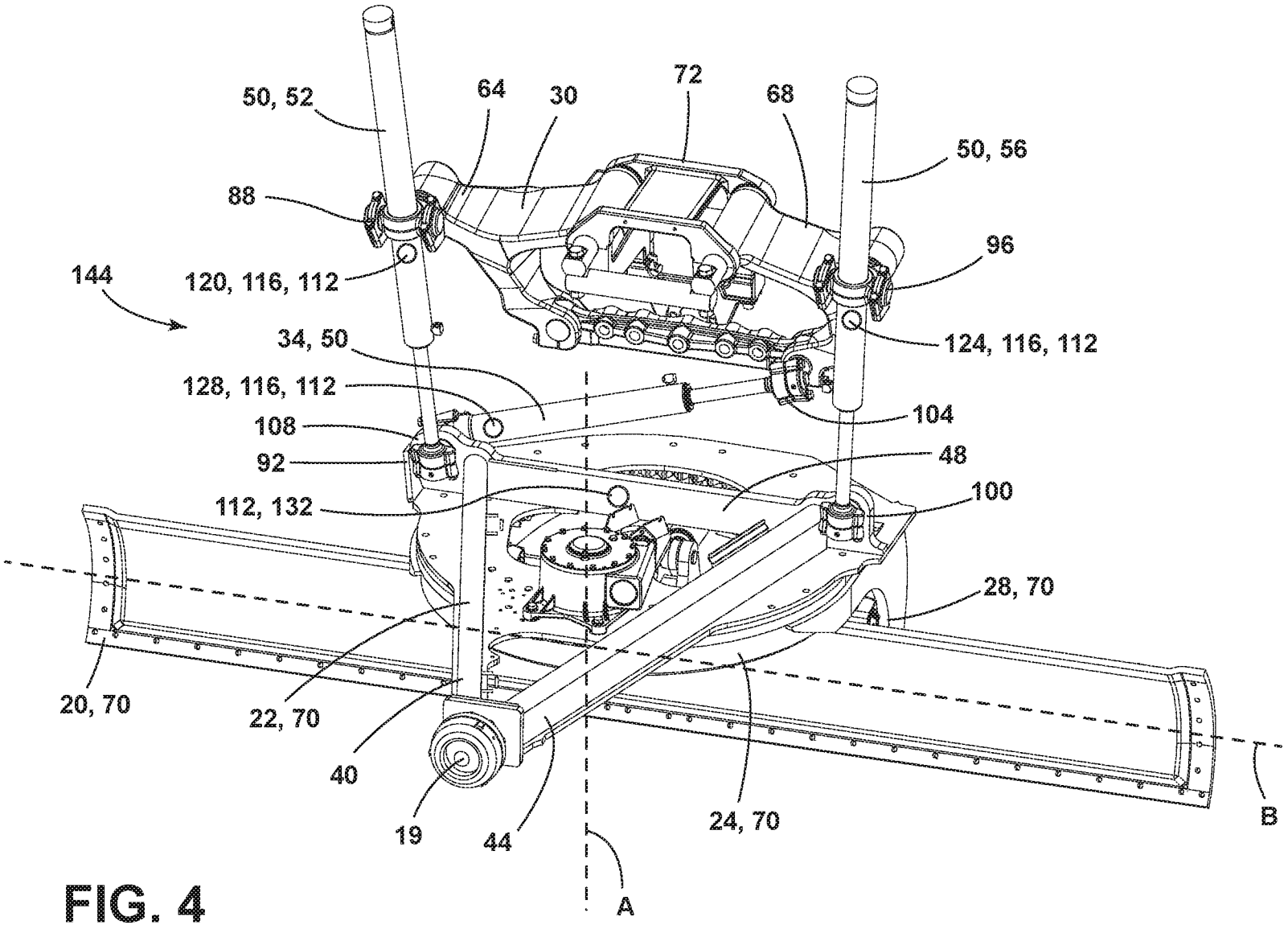
FIG. 4 is a front perspective view of the operational frames of the motor grader of FIG. 1.

With reference to FIGS. 3-4, the draft frame 22 is a generally triangular frame that extends below the main frame 18 from a front end of the main frame 18 to a rear end of the main frame 18. The triangular shape of the draft frame 22 is formed by a left draw bar 40, a right draw bar 44, and a cross bar 48. The draft frame 22 is coupled to the front end of the main frame 18 by a ball joint 19, which enables the draft frame 22 to move in a plurality of different directions relative to the main frame 18. The ball joint 19 is formed at the intersection of the left draw bar 40 and right draw bar 44.

As shown in FIGS. 1-3, the draft frame 22 is coupled to the rear end of the main frame 18 by a saddle 30, left and right lift cylinders 52, 56, and a circle side-shift cylinder 34. The saddle 30 is mounted to the main frame 18, and the left and right lift cylinders 52, 56 extend between the saddle 30 and the draft frame 22 to support the draft frame 22 below the saddle 30.

Figure 5:
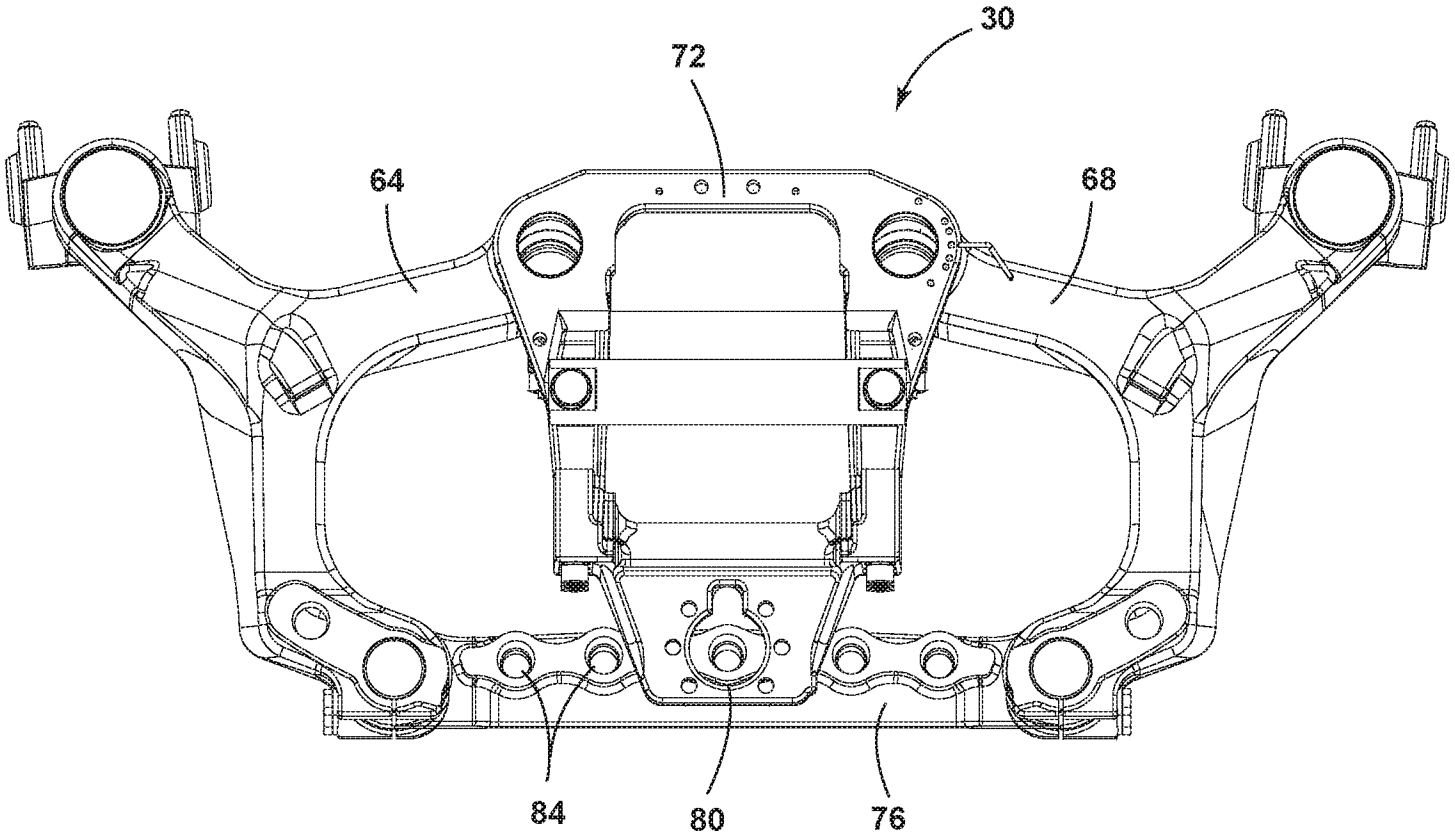
FIG. 5 is a detailed view of a saddle of the motor grader of FIG. 1.

FIG. 5 provides a detailed view of the saddle 30 according to one embodiment. The saddle 30 has a plurality of linkages 60, which can be adjusted to a predetermined number of discrete linkage arrangements. The illustrated saddle 30 includes four linkages 60 (i.e., a 4-bar linkage system), including a left link arm 64, a right link arm 68, a center link 72, and a bar link 76. The center link 72 includes a pin 80, which can selectively engage with a plurality of positioning holes 84 in the bar link 76. Each of the positioning holes 84 corresponds to one of the discrete linkage arrangements. The pin 80 can be moved from one positioning hole 84 to another positioning hole 84 to adjust the saddle 30 to different linkages arrangements. In the illustrated embodiment, the saddle 30 has five positioning holes 84 corresponding to five different linkage arrangements. However, in other embodiments, a greater or fewer number of positioning holes 84 may be used to achieve a greater or lesser number of linkage arrangements.

Referring back to FIG. 4, the saddle 30 connects the draft frame 22 to the main frame 18 by way of the left lift cylinder 52, the right lift cylinder 56, and the circle side-shift cylinder 34. Specifically, the left lift cylinder 52 is connected to the saddle 30 at a first connection point 88 located on a left link arm 64 of the saddle 30, and is connected to the draft frame 22 at a second connection point 92 located proximate the intersection of the left draw bar 40 and the cross bar 48. Likewise, the right lift cylinder 56 is connected to the saddle 30 at a first connection point 96 located on a right link arm 68 of the saddle 30, and is connected to the draft frame 22 at a second connection point 100 located proximate the intersection of the right draw bar 44 and the cross bar 48.

In the illustrated embodiment, the left and right lift cylinders 52, 56 are hydraulic actuators capable of raising and lowering the draft frame 22, and thus the circle frame 24 and the blade 20, relative to the main frame 18. For example, the left and right lift cylinders 52, 56 can raise and lower the draft frame 22 (i.e., in a generally vertical direction relative to the ground) by raising or lowering both the sides of the draft frame 22. Additionally, the left and right lift cylinders 52, 56 can pivot (i.e., roll) the draft frame 22 by raising or lowering one side of the draft frame 22 relative to the other side. The left and right lift cylinders 52, 56 may be used to adjust the roll of the blade 20 in order to align the blade 20 with the cross slope of the ground surface. The cross slope angle is the angle of the surface measured in the direction that is perpendicular to the direction the work machine 10 is traveling and relative to gravity.

The left and right lift cylinders 52, 56 raise and lower the draft frame 22 by moving along a stroke path from an extended position to a retracted position to adjust the length of the lift cylinders 52, 56. The length of the left and right lift cylinders 52, 56 determines the how low the draft frame 22 hangs below the main frame 18. For example, the draft frame 22 is at the lowest position below the main frame 18 (i.e., farthest from the main frame 18) when the left and right lift cylinders 52, 56 are fully extended to their greatest length. Contrarily, the draft frame 22 is at the highest position (i.e., closet to the main frame 18) when the left and right lift cylinders 52, 56 are fully retracted to their shortest length.

The length of the left and right lift cylinders 52, 56 can be measured along the longitudinal axis of the cylinder 52, 56 from a first end to a second end. In the illustrated embodiment, the lengths of the left and right lift cylinders 52, 56 are measured from a first end, located proximate the first connection point 88, 96 to a second end, located proximate the second connection point 92, 100 of the respective lift cylinder 52, 56.

With continued reference to FIG. 4, the circle side-shift cylinder 34 is also connected between the saddle 30 and the draft frame 22 to side-shift the draft frame 22, and in turn, the circle frame 24 and the blade 20, relative to the main frame 18. The circle side-shift cylinder 34 is a hydraulic actuator that can sweep the draft frame 22 left and right in a back and forth direction (i.e., in a generally horizontal direction relative to the ground). In addition to sweeping the draft frame 22 horizontally left and right, the circle side-shift cylinder 34 can also rotationally sweep the draft frame 22 in the yaw direction. Specifically, when the circle side-shift cylinder 34 works in conjunction with the circle frame 24, the horizontal movement of the side-shift cylinder 34 combined with the rotational movement of the circle frame 24, affects the position of the draft frame 22 and blade 20 in the yaw direction.

Similar to the left and right lift cylinders 52, 56, the circle side-shift cylinder 34 is connected to the saddle 30 at a first connection point 104 located on the right link arm 68 of the saddle 30, and is connected to the draft frame 22 at a second connection point 108 located proximate the intersection of the left draw bar 40 and the cross bar 48 of the draft frame 22. In other embodiments, the circle side-shift cylinder 34 is connected to the left link arm 64 of the saddle 30 and is connected to the draft frame 22 at a location proximate the right draw bar 44.

The circle side-shift cylinder 34 shifts the draft frame 22 left and right by moving along a stroke path from an extended position to a retracted position to adjust the length of the circle side-shift cylinder 34. The length of the circle side-shift cylinder 34 determines the how far left or right the draft frame 22 is shifted relative to the main frame 18. In the illustrated embodiment, the draft frame 22 is shifted farthest to the left when the circle side-shift cylinder 34 is fully extended to its greatest length. Contrarily, the draft frame 22 is shifted farthest to the right when the circle side-shift cylinder 34 is fully retracted to its shortest length. Similar to the left and right lift cylinders 52, 56, the length of the circle side-shift cylinder 34 can be measured along the longitudinal axis of the circle side-shift cylinder 34 from a first end to a second end. In the illustrated embodiment, the length of the circle side-shift cylinder 34 is measured from a first end, located proximate the first connection point 104 to a second end, located proximate the second connection point 108.

It should be understood by those skilled in the art that the connection points of the left lift cylinder 52, the right lift cylinder 56, and the circle side-shift cylinder 34 can be positioned at different locations on the saddle 30 and the draft frame 22. Furthermore, in some embodiments, the connection points may be located on the circle frame 24, or other components of the motor grader 10 that enable the draft frame 22 to be supported below the main frame 18 and moveable relative thereto.

Figure 6:
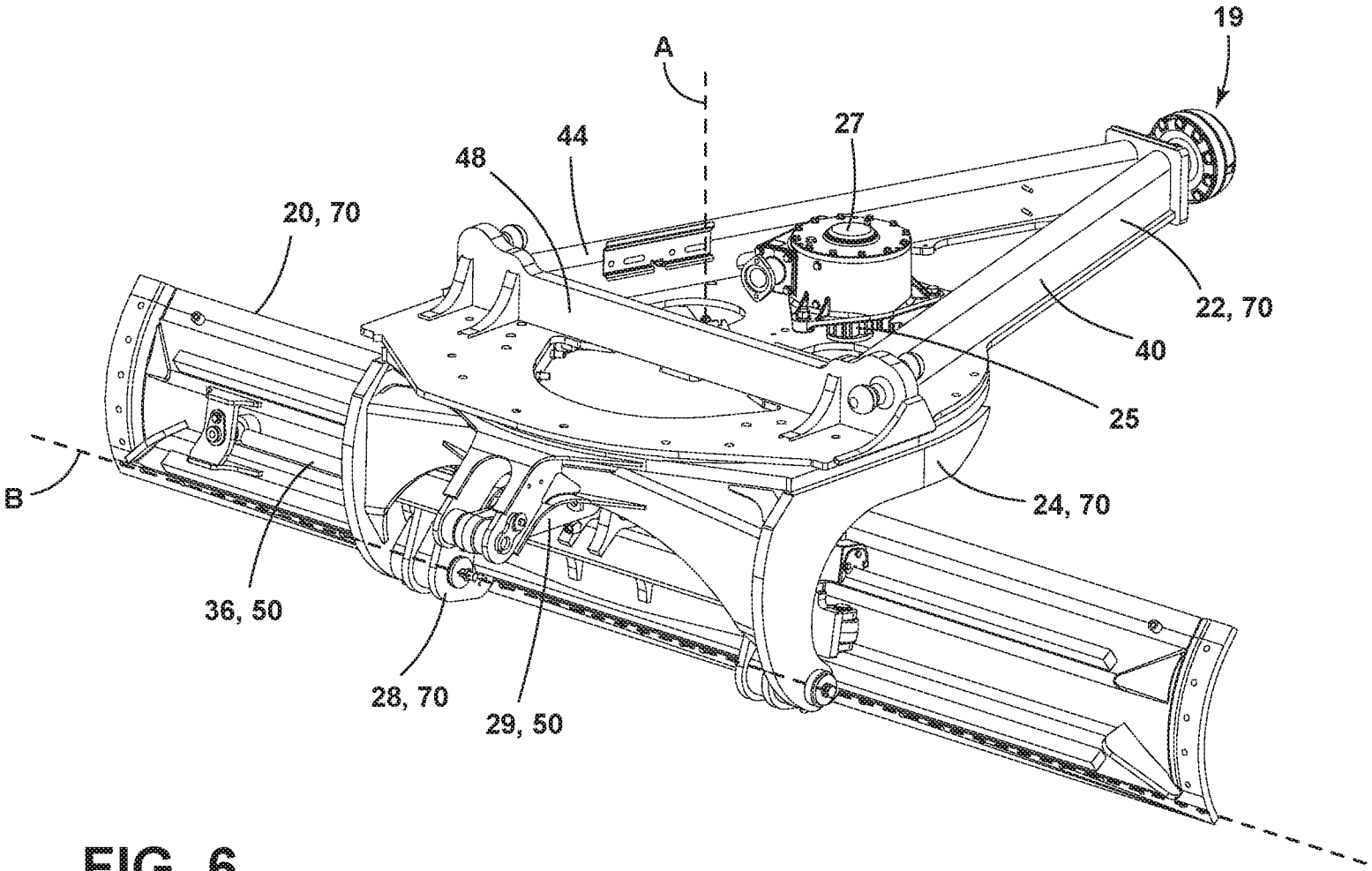
FIG. 6 is a rear perspective view of some of the operational frames of the motor grader of FIG. 1.

Referring to FIGS. 3-4 and 6, the circle frame 24 is mounted to and extends below the draft frame 22. The circle frame 24 is configured to rotate relative to the draft frame 22 about a central axis A. The circle frame 24 is rotated by a circle gear 25 and a circle drive 26 having a circle drive 26 gearbox 27 engaging the circle gear 25. Rotation of the circle frame 24 rotates the tilt frame 28 and the blade 20 about the central axis A (i.e., in a yaw direction). As previously mentioned, the position of the draft frame 22 in the yaw direction may be affected by both the circle frame 24 and the circle side-shift cylinder 34.

The tilt frame 28 holds the blade 20 and is pivotally coupled to the circle frame 24 for pivotal movement of the tilt frame 28 and the blade 20 relative to the circle frame 24. Specifically, the tilt frame 28 can increase or decrease the pitch of the blade 20 by rotating the blade 20 about a tilt axis B by use of a tilt cylinder 29. The tilt cylinder 29 is another hydraulic actuator connected to the circle frame 24 and the tilt frame 28. The tilt cylinder 29 increases or decreases the blade 20 by moving along a stroke path from an extended position to a retracted position to adjust the length of the tilt cylinder 29.

Additionally, a blade side-shift cylinder 36 is connected to the tilt frame 28 and the blade 20, and is operable to move the blade 20 in translation relative to the tilt frame 28 along a longitudinal axis of the blade 20 (i.e., in a generally horizontal direction relative to the ground). In the illustrated embodiment, the longitudinal axis of the blade 20 is parallel to the tilt axis B. The blade side-shift cylinder 36 translates the blade 20 from side to side by moving along a stroke path from an extended position to a retracted position to adjust the length of the blade side-shift cylinder 36.

As will be described in greater detail below, the length of the cylinders 29, 346, 52, and 56 (identified generally as cylinders 50) can be used to help determine the position of the blade 20. When using the length(s) of the cylinder(s) 50 as a one of the variables to help determine the position of the blade 20, it will be understood that the length of the cylinders 50 can be measured in different ways (e.g., using different end points). As will be understood by a person of ordinary skill in the art, the length of each cylinder 50 will be measured along the longitudinal axis of that cylinder 50, however, the exact location of the end points may vary slightly. For example, in some embodiments, the lengths of the left and right lift cylinders 52, 56 are measured from the connection points 92, 100 with the draft frame 22 to the connection points 88, 96 with the saddle 30, respectively. In other embodiments, the length of the left and right lift cylinders 52, 56 may be measured from the connection points 92, 100 with the draft frame 22 to the ends of the left and right lift cylinder 52, 56 (e.g., when the cylinder extends beyond the connection point with the saddle). Alternatively, the change in length may be used in place of the length.

As described above, the operational frames 70 of the motor grader 10, such as the draft frame 22, circle frame 24, tilt frame 28, or blade 20, can be moved in a plurality of different directions. For example, the blade 20 can be translated in a vertical or a horizontal direction, and can be rotated in a roll, a pitch, or a yaw direction. Accordingly, the illustrated motor grader 10 includes a plurality of sensors (identified generally as 112) to help track the position and movement of the draft frame 22 in order to assist the operator of the motor grader 10. As will be understood by one skilled in the art, the following description of sensors 112 is intended to be exemplary, however, different types and combinations of sensors 112 may be used in different embodiments.

As illustrated in FIGS. 3-4, the motor grader 10 may include a plurality of cylinder sensors 116 ("the cylinder sensors 116") that each monitor a parameter of a corresponding cylinder 50 related to the length of that cylinder 50. For example, the motor grader 10 may include first and second sensors 120, 124 on the left and right lift cylinders 52, 56. The first and second sensors 120, 124 help track the position of the left and right lift cylinders 52, 56 along the stroke path to determine the extent to which the left and right lift cylinders 52, 56 are extended or retracted. Thus, the first and second sensors 120, 124 are used to determine the length of the left and right cylinders 52, 56 based on the length of extension of the left and right cylinders 52, 56. In the illustrated embodiment, the first and second sensors 120, 124 are linear position sensors 112 or encoders. However, in other embodiments, the first and second sensors 120, 124 can be other types of sensors 112 that indicate the position of the left and right lift cylinders 52, 56 such that the length of the cylinder 50 can be determined. Specifically, the first and second sensors 120, 124 can be any type of sensor 112 configured to measure a parameter related to the length of a cylinder 50. For example, the first and second sensors 120, 124 may be position sensors 112, which represent a location along the axis of the cylinder 50. The first and second sensors 120, 124 may be used to determine a change in cylinder length, for example, by identifying a change in location along the axis of the cylinder 50. Similarly, the first and second sensors 120, 124 may be used to determine a change in cylinder length by measuring the amount of hydraulic fluid that is pumped through the cylinder 50.

Similarly, the motor grader 10 includes a third sensor 128 located on the circle side-shift cylinder 34. The third sensor 128 tracks the position of the circle side-shift cylinder 34 along the stroke path to determine the extent to which the left and right lift cylinders 52, 56 are extended or retracted, and thus, the length of the circle side-shift cylinder 34. In the illustrated embodiment, the third sensor 128 is a linear position sensor 112 or encoder. However, in other embodiments, the third sensor 128 can be another type of sensor 112 that indicates the position of the circle side-shift cylinder 34. For example, the third sensor 128 may be any of the sensors 112 configured to measure a parameter related to the length of a cylinder, as described above with respect to the first and second sensors 120, 124.

Additionally, in some embodiments, the motor grader 10 includes a fourth sensor 132 on the circle frame 24. The fourth sensor 132 can be used to determine the degree to which the circle frame 24 is rotated about the central axis A. In the illustrated embodiment, the fourth sensor 132 is a rotary sensor, magnetic sensor, angular encoder, or another type of sensor 112 capable of determining the degree of rotation of the circle frame 24.

As shown in FIG. 2, in some embodiments, the motor grader 10 includes a fifth sensor 136 located on the main frame 18. The fifth sensor 136 can be an inertial sensor 112 that is capable of providing a reference to gravity. The fifth sensor 136 can also be an inertial sensor 112 or other type of sensor 112 capable of sensing the roll and/or pitch of the main frame 18. The motor grader 10 may also include a sixth sensor 140 positioned downstream of the main frame 18, for example, on the draft frame 22, circle frame 24, or tilt frame 28. The sixth sensor 140 may be an inertial sensor 112 capable of identifying relative movement between the sixth sensor 140 and another sensor, such as the fifth sensor 136. As will be explained in greater detail below, the fifth sensor 136 and the sixth sensor 140 may be used to sense movement or looseness between the main frame 18 and the draft frame 22 (or circle frame 24 or tilt frame 28 depending on the location of the sixth sensor).

As will be understood by a person of ordinary skill in the art, the aforementioned sensors 112 may be a variety of different sensors 112 known in the art that are capable of performing the function described herein. Additionally, it should be understood that the motor grader 10 may include a greater or fewer number of sensors 112, or a different combination of sensors 112 than those discussed above. For example, in some embodiments, the motor grader 10 may include multiple sensors 112 in place of one of the sensors 112 discussed above. In other embodiments, one or more of the sensors 112 may be excluded from the motor grader 10. In some embodiments, one or more sensor 112 may be replaced by a user input that can be manually input by an operator of the motor grader 10 via a user interface. Alternatively, one or more senor may be replaced by machine logic or other control systems to identify a parameter that would otherwise be measured by a sensor 112 described herein.

Figure 7:
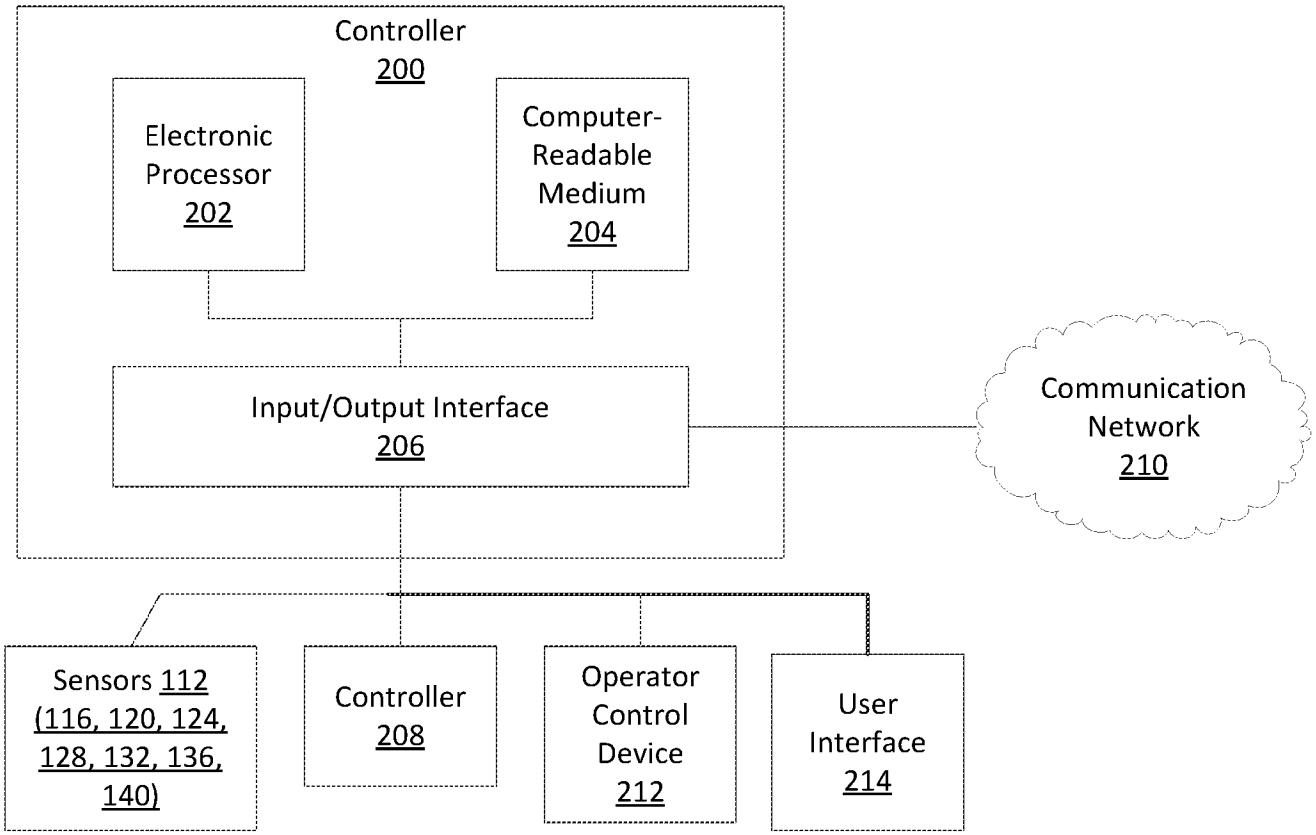
FIG. 7 is a schematic diagram of a control system according to one embodiment.
Figure 9:
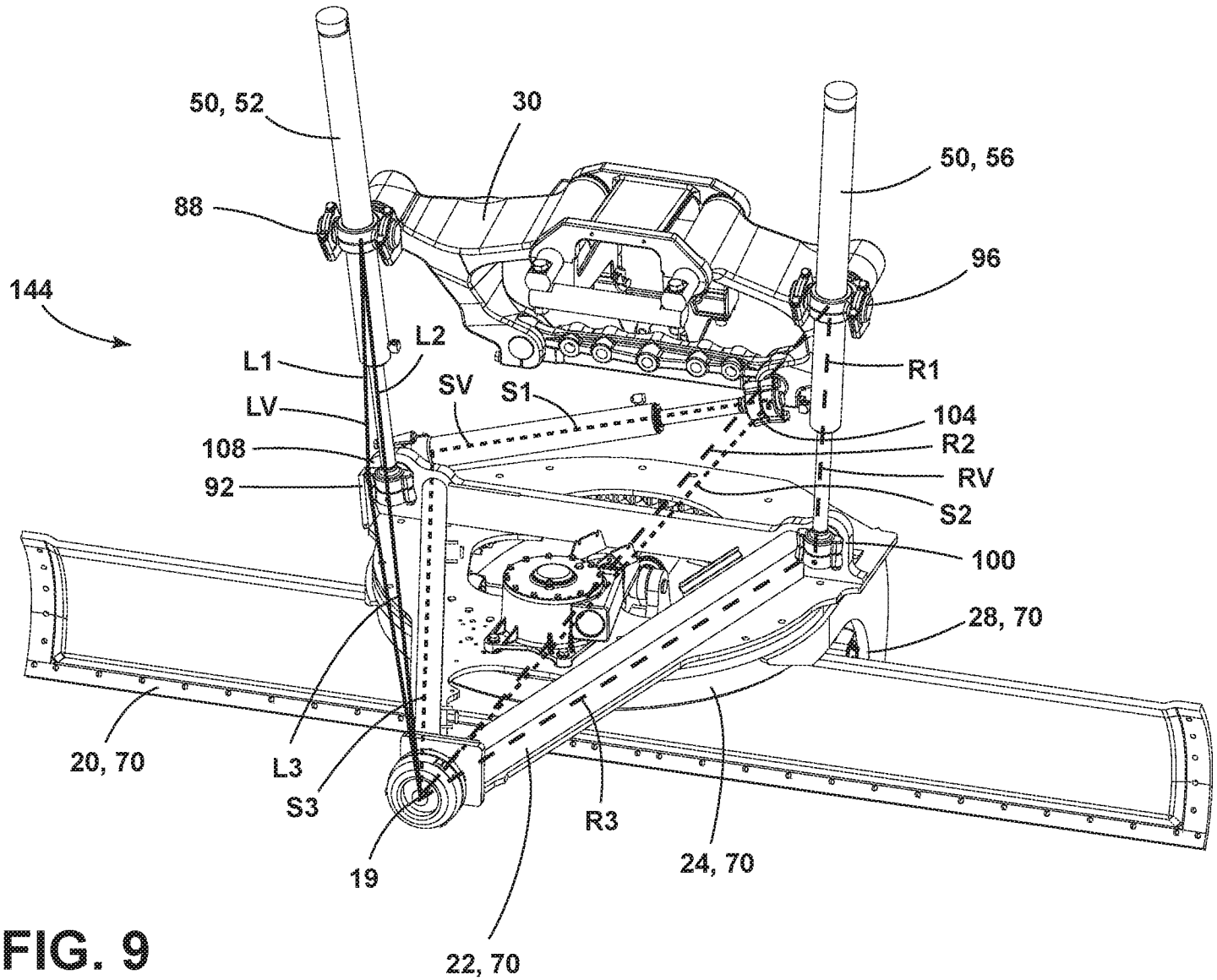
FIG. 9 is a perspective view of a linkage system coupling an operational frame to a main frame (not shown) with vector loops overlaid on the linkage system.

With reference to FIG. 7, the motor grader 10 also includes one or more controllers 200 for controlling the components of the motor grader 10. For example, FIG. 7 schematically illustrates a controller 200 included in the motor grader 10 according to one embodiment. As illustrated in FIG. 9, the controller 200 includes an electronic processor 202 (for example, a microprocessor, application specific integrated circuit (ASIC), or other electronic device), an input/output interface 206, and a computer-readable medium 204. The electronic processor 202, the input/output interface 206, and the computer-readable medium 204 are connected by and communicate through one or more communication lines or busses. It should be understood that the controller 200 may include fewer or additional components than those illustrated in FIG. 7 and may include components in configurations other than the configuration illustrated in FIG. 7. Also, the controller 200 may be configured to perform additional functionality than the functionality described herein. Additionally, the functionality of the controller 200 may be distributed among more than one controller 200. For example, the controller 200 may communicate with one or more additional controllers 208. The additional controllers 208 may be internal or external to the controller 200. Likewise, the functionality described herein as being performed by the electronic processor 202 may be performed by a plurality of electronic processors included in the controller 200, a separate device, or a combination thereof. Furthermore, in some embodiments, the controller 200 may be located remote from the motor grader 10.

The computer-readable medium 204 includes non-transitory memory (for example, read-only memory, random-access memory, or combinations thereof) storing program instructions (software) and data. The electronic processor 202 is configured to retrieve instructions and data from the computer-readable medium 204 and execute, among other things, the instructions to perform the methods described herein. The input/output interface 206 transmits data from the controller 200 to external systems, networks, devices, or a combination thereof and receives data from external systems, networks, devices, or a combination thereof. The input/output interface 206 may also store data received from external sources to the computer-readable medium 204, provide received data to the electronic processor 202, or both. In some embodiments, as illustrated in FIG. 7, the input/output interface 206 includes a wireless transmitter that communicates with a communication network 210.

The controller 200 may communicate with one or more sensors 112 (for example, through the input/output interface 206). The controller 200 is configured to receive information from the sensors 112 related to the position of the draft frame 22, and use the received information to track the position of the draft frame 22. In some embodiments, the controller 200 communicates with the sensors 112 over a wired or wireless connection directly or through one or more intermediary devices, such as another controller 200, an information bus, the communication network 210, and the like. Similarly, the controller 200 may communicate with one or more additional controllers 208 associated with the motor grader 10. In some embodiments, the additional controller 208 may communicate with the sensors 112 and may act as an intermediary device between the controller 200 and the sensors 112.

One or more of the controllers 200 or 208 may also be configured to operate components of the motor grader 10. For example, the controller 200 may be configured to control the operational frames 70 of the motor grader 10, such as controlling the movement of the draft frame 22, the circle frame 24, the tilt frame 28, or the blade 20. More specifically, the controller 200 may control the components of the motor grader 10 by controlling one or more of the left and right cylinders 52, 56, the circle side-shift cylinder 34, the circle gear 25, the tilt cylinder 29, or the blade 20 side-shift cylinder 36, etc. The controller 200 may be configured to determine a position of the draft frame 22, and the controller 200 may control the components of the motor grader 10 based on the current position of the draft frame 22 and a desired position of the draft frame 22. Alternatively, the controller 200 may output the desired position of the draft frame 22 to a separate controller 208 configured to control the components of the motor grader 10 to achieve the desired position.

In some embodiments, the controller 200 also receives input from one or more operator control devices 212 (for example, a joystick, a lever, a button, a foot pedal, another actuator operated by the operator to control the operation of the motor grader 10, or a combination thereof). For example, an operator may use the operator control devices 212 to operate the motor grader 10, including commanding movement of the draft frame 22, the circle frame 24, the tilt frame 28, or the blade 20. In some embodiments, the controller 200 also communicates with one or more user interfaces 214 (for example, through the input/output interface 206), such as a display device or a touchscreen. The user interfaces 214 may display feedback to an operator regarding. For example, user interfaces 214 may provide information regarding the position of the draft frame 22, the circle frame 24, the tilt frame 28, or the blade 20. Also, in some embodiments, the user interfaces 214 allow an operator to input data, such as operational data or instructions for the motor grader 10. For example, the operator may input data regarding the saddle 30 linkage arrangement being used, the desired position of the draft frame 22, or data related to the cross slope angle.

The controller 200 is configured to perform a method of tracking and/or controlling the position of at least one operational frame 70 (i.e., the draft frame 22, the circle frame 24, the tilt frame 28, or the blade 20). In some embodiments, the controller 200 may be configured to automatically assist the operator in controlling the operational frames 70 of the motor grader 10 to achieve a desired position of the operational frame 70 or to maintain the operational frame 70 within certain desired parameters.

In the illustrated embodiment, the controller 200 tracks the position of the blade 20 by tracking the position of the draft frame 22. Specifically, the controller 200 is configured to track the position and/or orientation of the draft frame 22 by tracking the position of the cylinders 50 controlling the draft frame 22 (i.e., the left lift cylinder 52, the right lift cylinder 56, and the circle side-shift cylinder 34). As the cylinders 50 move between an extended position and a retracted position, the length of each cylinder 50 increases or decreases, affecting the position and/or orientation of the draft frame 22. Thus, the controller 200 can track the cylinders 50 along the path of their stroke length in order to determine the position of the draft frame 22 relative to the main frame 18. Once the controller 200 has determined the position of the draft frame 22, the controller can determine the position of the blade 20 relative to the draft frame 22, and thus, relative to the main frame 18. The controller 200 determines the position of the blade 20 by tracking the position of the remaining cylinders 50 (i.e., the tilt cylinder 29 and the blade side-shift cylinder 36) and the angle of rotation of the circle frame 24.

Tracking the position of the draft frame 22 based on the position of the cylinders 50 can be a complex task, due to the large number of degrees of freedom, as well as the arrangement of the cylinders 50. Specifically, the draft frame 22 has three degrees of freedom about the ball joint 19 (i.e., the primary joint) and two angular degrees of freedom for each of the cylinders 50 (i.e., the left and right lift cylinders 52, 56 and the circle side-shift cylinder 34). Furthermore, the cylinders 50 form a parallel linkage system 144, making the coordinates of the draft frame 22 more difficult to solve. If, for example, the left and right lift cylinders 52, 56 were arranged in a simplistic manner whereby each left and right lift cylinders 52, 56 controls a single degree of freedom of the draft frame 22, there would be a 1 to 1 correspondence between the cylinder length and the machine configuration. This information could then be used to solve for the position of the draft frame 22. However, in the illustrated embodiment, tracking the draft frame 22 is more complicated due to the number of degrees of freedom provided to the draft frame 22. Additional complications arise due to the parallel linkage arrangement of the cylinders 50. For example, while a serial linkage system could be solved using a closed form solution, the parallel linkage system 144 cannot be solved using a closed form solution. Instead, the illustrated parallel linkage system 144 can be solved using an iterative method, as described below, to track the position of the draft frame 22 as it moves relative to the main frame 18.

Figure 8:
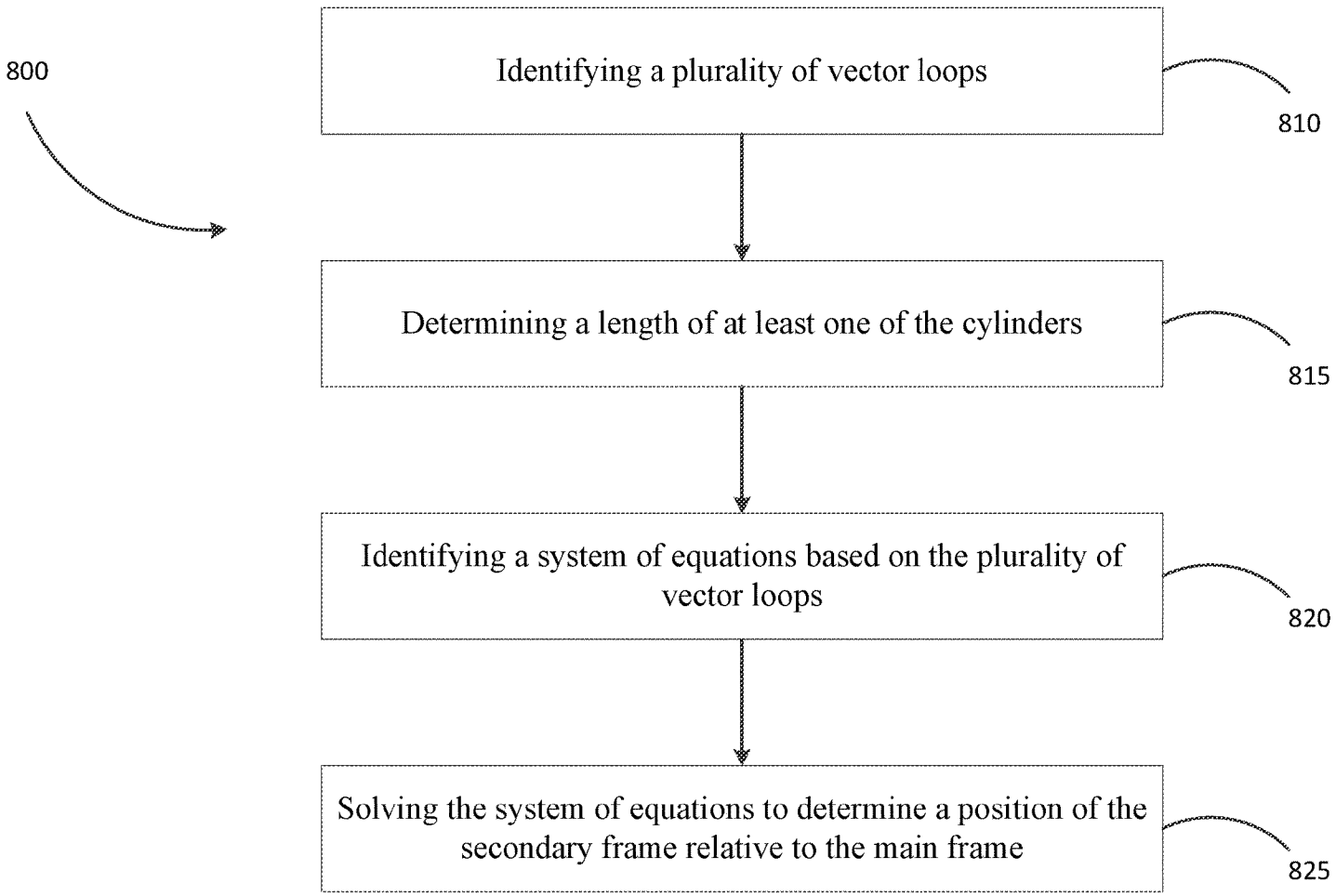
FIG. 8 is a flow chart of a system and method of tracking the position of secondary frame relative to a main frame according to a first embodiment.

Accordingly, FIG. 8 provides a system and method of tracking the position of the draft frame 22 and/or blade 20 using the cylinder 50 positions, which addresses the complications associated with the number of degrees of freedom and the parallel linkage system 114 of the cylinders 50. The method of FIG. 8 can be carried out by the controller 200 or one or more processors. In some embodiments, the steps in the method may be conducted automatically, without user input. In other embodiments, one or more of the steps may require user input or a user to initiate a step.

FIG. 8 provides method of tracking movement of a motor grader 10, where the motor grader 10 includes a main frame 18, an operational frame 70 configured to move relative to the main frame 18, and a linkage system 144 coupling the operational frame 70 to the main frame 18. As used herein, the operational frame 70 refers to any one of, or combination of, the blade 20, the draft frame 22, the circle frame 24, and the tilt frame 28. The linkage system 144 includes a plurality of cylinders 50 that are moveable between an extended position and a retracted position to adjust the length of the cylinder 50. The method includes identifying a plurality of vector loops (Step 810) formed by the linkage system 144 where each vector loop corresponds to one of the cylinders 50 in the linkage system 144. Specifically, each cylinder 50 in the linkage system 144 corresponds to one of the vectors in the associated vector loop. The method also includes determining a length of at least one of the cylinders 50 (Step 815). The method further includes identifying a system of equations based on the plurality of vector loops (Step 820), and solving the system of equations to determine a position of the operational frame 70 relative to the main frame 18 (Step 825). Additional details of the method are described below.

Figure 10:
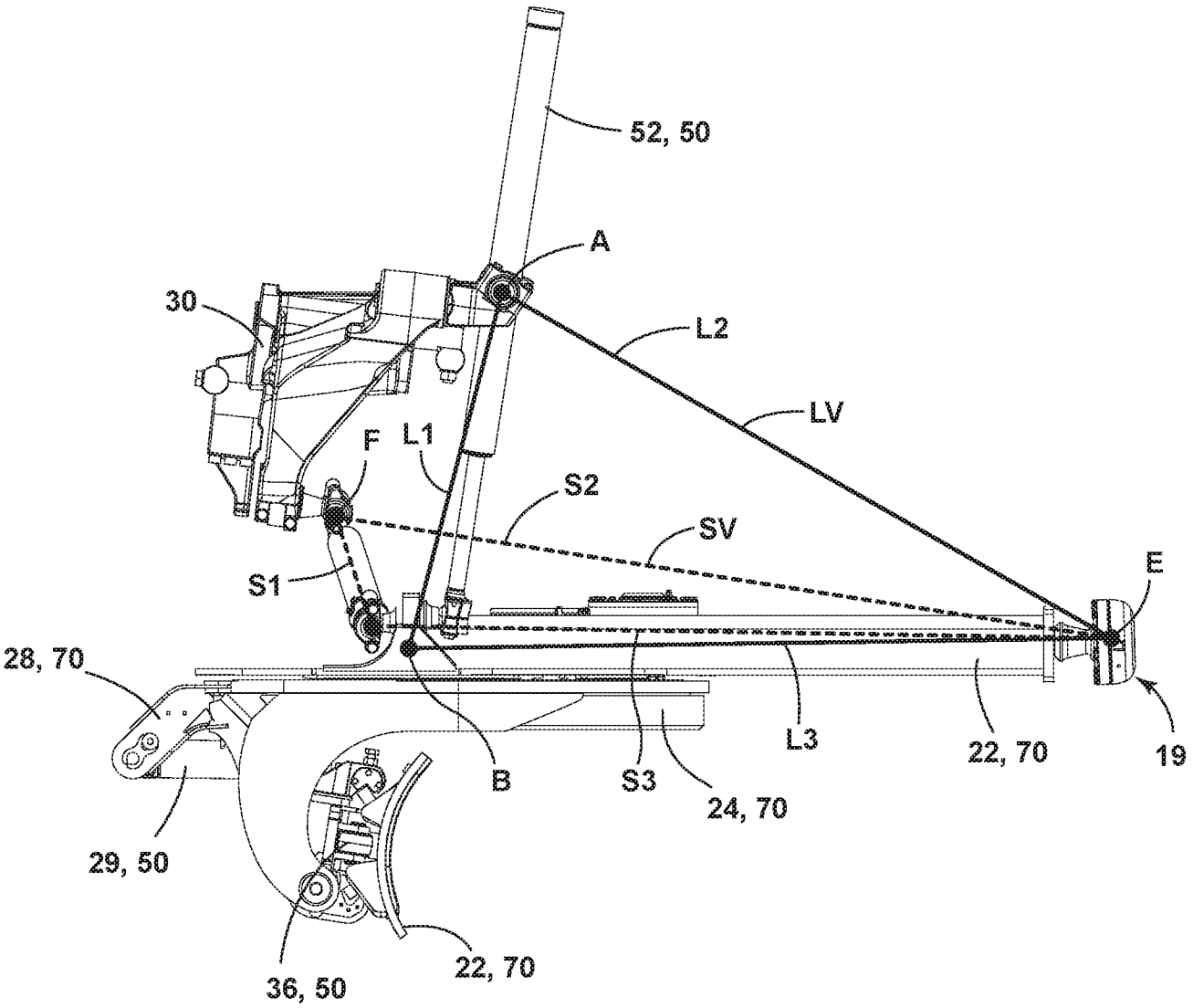
FIG. 10 is a first side view of the linkage system illustrated in FIG. 9.
Figure 11:
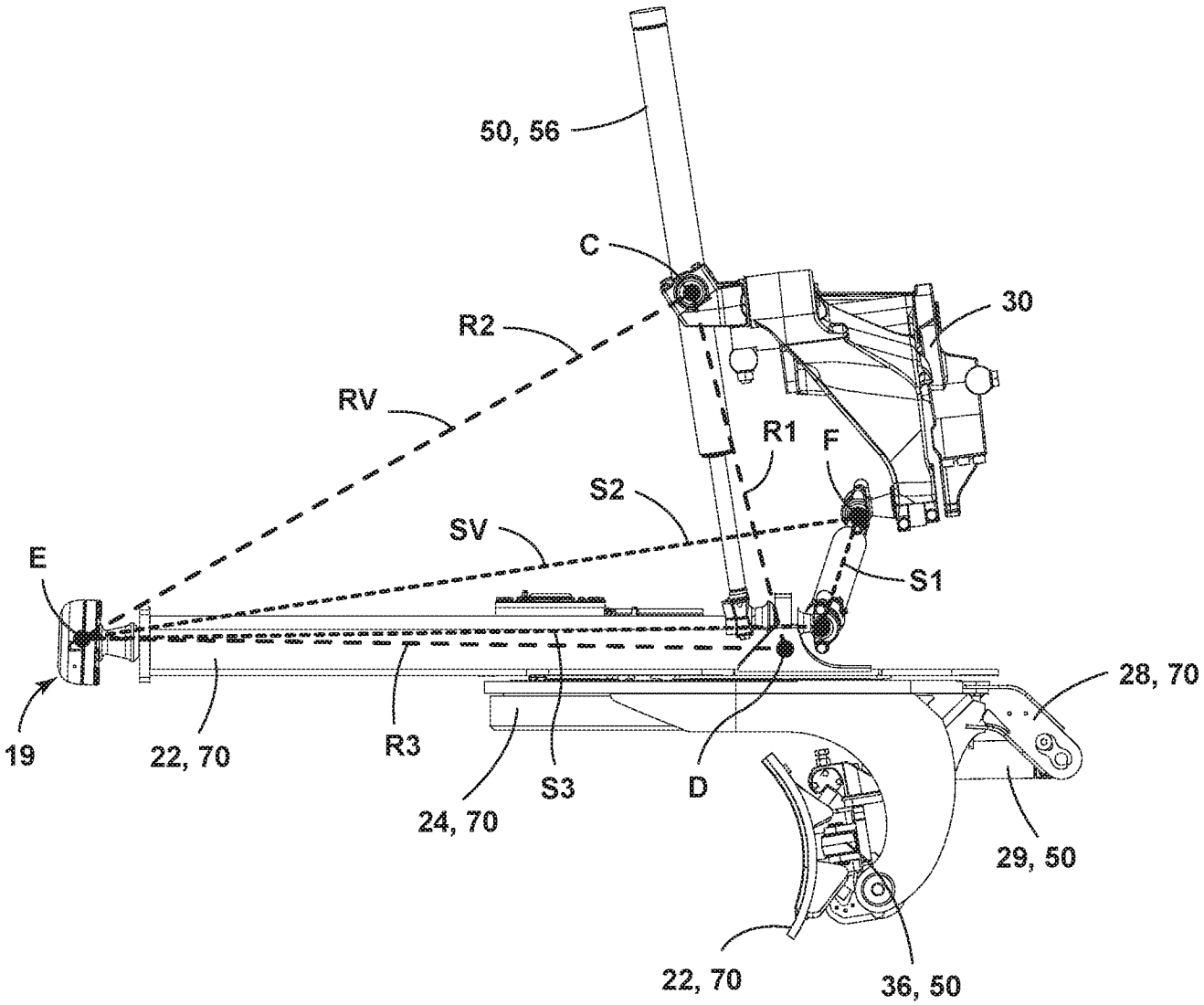
FIG. 11 is a second side view of the linkage system illustrated in FIG. 9.

Referring to FIGS. 9-11, the method includes identifying a plurality of vector loops (Step 810) formed by the linkage system 144 where each vector loop corresponds to one of the cylinders 50 in the linkage system 144. A vector loop can be identified between the ball joint 19 and each of the cylinders 50 adjusting the position of the draft frame 22 (i.e., the left lift cylinder 52, the right lift cylinders 56, and the circle side-shift cylinder 34). In other words, for each cylinder 50 in the linkage system 144, a corresponding vector loop is identified. Specifically, a vector loop can be drawn along the length of each cylinder 50, from a first end of the cylinder 50 to the ball joint 19, and from the ball joint 19 to a second end of the cylinder 50.

Figure 12:
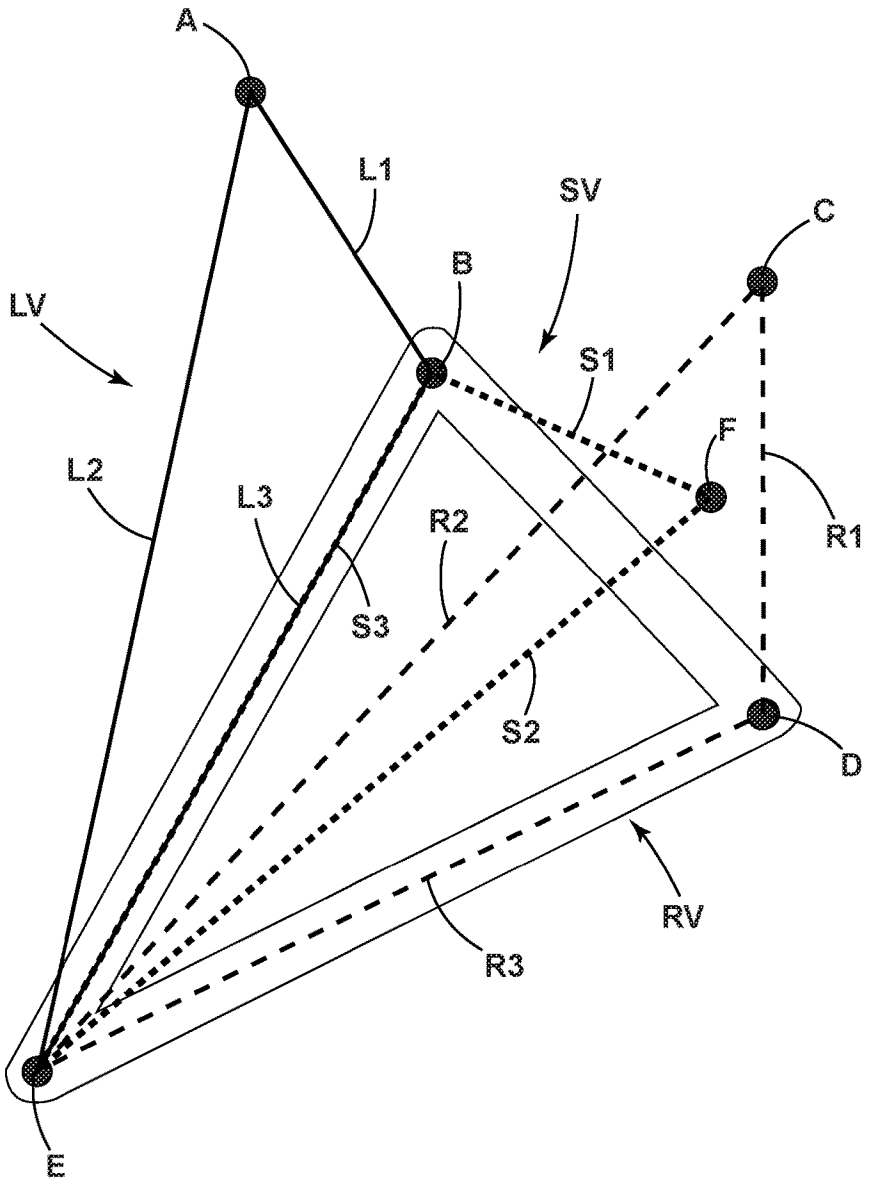
FIG. 12 is a schematic diagram of the linkage system illustrated in FIG. 9

FIGS. 9-11 illustrate the vector loops schematically overlaid on the top of the motor grader 10. FIG. 12 illustrates a schematic diagram of the vector loops alone. The left lift cylinder 52 forms a vector loop (LV—i.e., the "left vector loop") with the ball joint 19 by drawing a first vector (L1) along the length of the left lift cylinder 52, a second vector (L2) from a first end of the left lift cylinder 52 to the ball joint 19, and a third vector (L3) from the ball joint 19 to a second end of the left cylinder 50. More specifically, the first vector (L1) extends along the axis of the left lift cylinder 52 between a point A, located proximate the first connection point 88 between the left lift cylinder 52 and the saddle 30, and a point B, located proximate the second connection point 92 between the left lift cylinder 52 and the draft frame 22. The second vector (L2) extends between point A, at the first connection point 88, and a point E, located proximate the ball joint 19. The third vector (L3) extends between point E, at the ball joint 19, and point B, at the second connection point 92.

Similarly, the right lift cylinder 56 forms a vector loop (RV—i.e., the "right vector loop") with the ball joint 19 by drawing a first vector (R1) along the length of the right lift cylinder 56, a second vector (R2) from a first end of the right lift cylinder 56 to the ball joint 19, and third vector (R3) from the ball joint 19 to a second end of the right lift cylinder 56. More specifically, the first vector (R1) extends along the axis of the right lift cylinder 56 between a point C, located proximate the first connection point 96 between the right lift cylinder 56 and the saddle 30, and a point D, located proximate the second connection point 100 between the right lift cylinder 56 and the draft frame 22. The second vector (R2) extends between point C, at the first connection point 96, and point E, located proximate the ball joint 19. The third vector (R3) extends between point E, at the ball joint 19, and point D, at the second connection point 100.

The circle side-shift cylinder 34 also forms a vector loop (SV—i.e., the "side vector loop") with the ball joint 19 by drawing a first vector (S1) along the length of the side-shift cylinder, a second vector (S2) from a first end of the circle side-shift cylinder 34 to the ball joint 19, and a third vector (S3) from the ball joint 19 to a second end of the circle side-shift cylinder 34. More specifically, the first vector (S1) extends along the axis of the circle side-shift cylinder 34 between point F, located proximate the first connection point 104 between the circle side-shift cylinder 34 and the saddle 30, and point B, located proximate the second connection point 108 between the circle side-shift cylinder 34 and the draft frame 22. The second vector (S2) extends between point F, at the first connection point 104, and point E, located proximate the ball joint 19. The third vector (S3) extends between point E, at the ball joint 19, and point B, at the second connection point 108.

With continued reference to FIGS. 9-11, the third vectors (L3, R3, S3) in each of the vector loops (LV, RV, SV) have a fixed length such that the magnitude of these vectors (L3, R3, S3) remains constant. For example, the third vector (L3) in the left vector loop (LV) and the third vector (S3) in the side vector loop (SV) both extend along a path that generally corresponds to the left draw bar 40. Specifically, because the left draw bar 40 has a fixed length, the distance between the ball joint 19 at point E and the second ends of the left lift cylinder 52 and the circle side-shift cylinder 34 at point B is constant. Likewise, the third vector (R3) in the right vector loop (RV) extends along a path generally corresponding to the right draw bar 44, which also has a fixed length. Thus, the distance between the ball joint 19 at point E and the second end of the right lift cylinder 56 at point D is constant. Note, that although the third vectors (L3, R3, S3) each have a fixed magnitude, these vectors (L3, R3, S3) do not necessarily have a fixed direction.

On the other hand, the lengths of the first vectors (L1, R1, S1) in each of the vector loops (LV, RV, SV) are variable such that the magnitudes of these vectors (L1, R1, S1) can change depending on the length of the corresponding cylinder 50. Specifically, as the cylinders 50 extend or retract, the lengths of the cylinders 50, and thus, the first vectors (L1, R1, S1) of each of the cylinders 50 change. The first vectors (L1, R1, S1) also have variable directions.

As previously mentioned, the linkage system 144 is a parallel linkage system 144 in which the plurality of cylinders 50 is operationally connected such that movement of one cylinder 50 of the plurality of cylinders 50 causes movement of at least another cylinder 50 of the plurality of cylinders 50. Therefore, movement of one of the cylinders 50 (i.e., extension or retraction of a cylinder) can change a plurality of the vectors. In other words, movement of one of the cylinders 50 can alter either the magnitude or direction (or both) of at least one vector in the vector loops (LV, RV, SV).

In the illustrated embodiment, the parallel linkage system 144 is formed as follows. However it should be understood that the following linkage system 144 is intended to be exemplary and many other parallel linkage arrangements can be used. In the illustrated embodiment, the second end of the left lift cylinder 52 is fixed relative to the second end of the circle side-shift cylinder 34. In turn, the first end of the circle side-shift cylinder 34 is fixed relative to the first end of the right lift cylinder 56. Accordingly, the third vectors (L3, S3) of the left vector loop (LV) and the side vector loop (SV) are in a fixed relationship. Likewise, the second vectors (R2, S2) of the right vector loop (RV) and the side vector loop (SV) are in a fixed relationship. For example, in the illustrated embodiment, the third vectors (L3, S3) of the left vector loop (LV) and the side vector loop (SV) are in a fixed relationship whereby the third vectors (L3, S3) have the same magnitude and direction. Additionally, the third vectors (R3, S3) of the right vector loop (RV) and the side vector loop (SV) are in a fixed relationship whereby the third vectors (R3, S3) have the same magnitude and direction. In other embodiments, vectors that are in a fixed relationship do not necessarily have the same magnitude and direction, however, because they are in a fixed relationship, knowing the magnitude and direction of one of the vectors enables the controller 200 to determine the magnitude and direction of the other of the vector.

The constraints of the linkage system 144 enable the controller 200 to determine the position and/or orientation of the draft frame 22 based on the vector loop configuration. Specifically, due to the constraints of the linkage system 144, such as the parallel linkage arrangement, the fixed lengths (i.e., magnitudes) of some of the vectors, and the fixed relationship between some of the vectors, the controller 200 is able determine the direction of the vectors when the magnitudes are known. Once the direction and magnitude of the vectors is known, the position and orientation of the draft frame 22 is also known. In other words, once all of the magnitudes of the vectors are known, the processor can solve for the directions of the vectors in order to determine the position and orientation of the draft frame 22 and blade 20.

Accordingly, the method includes determining a length of at least one of the cylinders 50 (Step 815). As previously mentioned, because the lengths of the cylinders 50 are constantly being adjusted as the motor grader 10 is operated, the first vectors (L1, R1, S1) are also changing. Therefore, the cylinder sensors 116 (i.e., the first, second, and third sensors 120, 124, 128) monitor a parameter of the cylinders 50 relating to the lengths of the cylinders 50. The parameter(s) measured by the cylinder sensors 116, is then transmitted from the cylinder sensors 116 to the controller 200 or processor. In some embodiments, all three of the cylinder sensors 116 transmit a parameter related to length to the controller 200. In other embodiments, only the cylinder sensors 116 corresponding to the cylinders 50 that moved (i.e., extended or retracted) will transmit the parameter to the controller 200.

Once the controller 200 receives one or more signal from the cylinder sensors 116, the controller 200 will determine the lengths of the cylinders 50, and in turn, will determine the magnitude of the corresponding vector. In the illustrated embodiment, the cylinder sensors 116 are position sensors 112, which are used to track the position of the cylinders 50 along the stroke path in order to determine the lengths of the cylinders 50 at a given time. As previously discussed, on other embodiments, the cylinder sensors 116 may monitor other parameters of the cylinders 50 relating to length of the cylinder 50. For example, in some embodiments, the cylinder sensors 116 may monitor the amount of hydraulic fluid that is transferred within the cylinder 50. In other embodiments, the cylinder sensors 116 may be rotary encoders that monitor the amount of movement of the cylinders 50. In each of these embodiments, the controller 200 will used the received parameter relating to length to calculate the length of the cylinder 50. The length of each cylinder 50 corresponds to the magnitude of the first vector (L1, R1, S1) in the associated vector loop (LV, RV, SV).

The method further includes identifying a system of equations based on the plurality of vector loops (Step 820). Once the controller 200 has determined the lengths of the cylinders 50, the magnitudes of the first vectors (L1, R1, S1) is known or can be easily determined by the controller 200. As previously mentioned, the third vectors (L3, R3, S3) in each of the vectors loops (LV, RV, SV) each have a fixed/constant magnitude, therefore these values are known by the controller 200. With the first vectors (L1, R1, S1) and the third vectors (L3, R3, S3) being known, the controller 200 can determine the second vectors (L2, R2, S2) in the vector loop (LV, RV, SV). For example, because each vector loop (LV, RV, SV) is a closed vector loop, the remaining unknown vector (i.e., the third vectors L3, R3, S3) can be easily determined using known methods.

Once the controller 200 determines the magnitudes of the vectors in each vector loop, the known values for the magnitudes can be inputted into a series of vector loop equations (referred to herein as "the vector loop equations"). The constraints on the system, as described in greater detail above, also provide additional constraints on the system of vector loop equations. These three vector loops (LV, RV, SV) provide a system of nine nonlinear equations, which are written for 9 unknowns: the three degrees of freedom about the ball joint 19 and the two angular degrees of freedom for each cylinder 34, 52, 56.

As will be understood by a person skilled in the art, different linkage arrangements will provide for a different system of equations. In particular, the known values and unknown values may be different depending on the specific linkage arrangement. Likewise, the fixed (i.e., constant) values and the varying values (i.e., adjustable values) may be different in other linkage arrangements. For example, when a greater or fewer number of cylinders 50 are used within the linkage system 144, the vector loop equations will be adjusted to account for the different number of varying vectors (i.e., non-fixed). Similarly, in some embodiments, some of the vectors may have a fixed direction and varying magnitude, rather than having a fixed magnitude and a varying direction.

Regardless of the linkage arrangement, the controller 200 is configured to determine the system of equations based on the known fixed values (e.g., vectors with fixed magnitudes), the measured variable values (e.g., vectors with varying magnitudes that are measured via the cylinder sensors 116), and the constraints on the system (e.g., certain vectors being fixed relative to one another). The controller 200 is then configured to determine the position of the draft frame 22 based on the solution to the system of equations.

Accordingly, the method further includes solving the system of equations to determine a position of the operational frame 70 relative to the main frame 18 (Step 825). As will be understood by a person of ordinary skill in the art, the terms "solved," "solving," and "solution" as used herein are intended include an estimated solution. For example, the solution to the system of equations may include an estimated solution based on an iterative method that converges to a theoretical solution.

The controller 200 is configured to solve the system of equations in order to determine the position of the draft frame 22. The vector loop equations are non-separable and should be solved simultaneously. The vector loop equations can be solved by the controller 200 using nonlinear root solving algorithms, such as, for example, Newton-Raphson iteration methods, quasi-Newton methods, secant methods, gradient descent methods, etc.

Several difficulties arise when using a nonlinear root solving methods, which typically make these methods undesirable. These difficulties are particularly problematic when attempting to use nonlinear root solving methods in combination with a machine, such as a motor grader 10. First, root solving methods, such as Newton's method, are iterative methods, which typically require an unknown number of iterations to be executed until a desired convergence is reached. For example, an iterative method involves solving the system of equations (i.e., executing a first iteration) to determine a first estimated solution. The first estimated solution is then used as a basis or an estimate from which to start the second iteration. Thus, the iterative method includes solving the system of equations for a second time (i.e., executing a second iteration) to determine a second estimated solution. Again, the second estimated solution is used as a base to help guide the solution when solving the system of equations for the third time (i.e., the executing a third iteration). The method continues until a desired convergence and accuracy is reached. In other words, iterations of the method are executed until the estimated solution converges towards a theoretical solution.

This can cause the controller 200 to stall due to the processing time requires to execute a sufficient number of iterations until a desired convergence is reached. Furthermore, once the controller 200 stalls, the machine may become inoperable, or some of the control systems may be hindered. On the other hand, when an insufficient number of iterations are executed, the solution may be inaccurate and may cause the machine to be poorly operated. For example, if the solution to the system of equations is inaccurate, the controller 200 will base the control operations on an inaccurate understanding of where the draft frame 22 (and blade 20) is positioned or oriented.

In the illustrated embodiment, the controller 200 is configured to solve the system of equations in a manner which reduces the complications typically associated with using nonlinear root solving methods. In the illustrated embodiment, the control is configured to estimate a position of the draft frame 22 relative to the main frame 18 by executing a first series of iterations to approximate a solution to the system of vector loop equations. In the described embodiment, the first series of iterations is limited to a maximum number of iterations. For example, upon start-up of the motor grader 10, the controller 200 executes a first series of iterations, with the maximum number of iterations being 10 or less iterations. In some embodiments, the first series of iterations may be as few as 4 iterations. The controller 200 then uses the estimated solution to the first series of iterations to determine an initial position of the draft frame 22 relative to the main frame 18.

During operation, the controller 200 continues to solve the system of vector loop equations based on the signals received from the cylinder sensors 116 representing a parameter related to the lengths of the cylinders 50. In other words, as the motor grader 10 is operated and the cylinders 50 are adjusted (i.e., extended and retracted) in order to move the draft frame 22, the sensors 112 transmit a signal to the controller 200 to provide a sensed parameter related to the length of the cylinders 50. The controller 200 then identifies the new vector equations and solves the new system of equations to determine an updated position of the draft frame 22. Accordingly, during operation, the controller 200 executes a second series of iterations to determine the new position of the draft frame 22 after movement has occurred. The second series of iterations also has a maximum number of iterations. In the illustrated embodiment, the second series of iterations comprises a few number of iterations than the first series of iterations. For example, the second series of iterations may include 4 or fewer iterations. In some embodiments, the second series of iterations can be as few as 1 iteration.

As the motor grader 10 continues to be operated, the controller 200 will continue to receive signals from the cylinder sensors 116 representing a parameter related to the lengths of the cylinders 50. The controller 200 will then execute additional series of iterations to determine the new position of the motor grader 10. Each of the series of iterations that occur after start up (i.e., after the first series of iterations), includes a few number of iterations than the first series of iterations. In other words, the controller 200 will execute a first series of iterations upon start up to determine an initial position of the draft frame 22 relative to the main frame 18. After the initial position is determined, the controller 200 will then execute a second, third, fourth, etc. series of iterations after each movement step to determine an updated position of the draft frame 22. Accordingly, after each movement step of the motor grader 10, the controller 200 is configured to executing a series of iterations to determine the position of the draft frame 22. Each of these later iterations will have a few number of iterations than the first series of iterations used to determine the initial position. This is, in part, because the previous solution estimating the position of the draft frame 22 can be used as the basis for executing the following series of iterations.

Once the controller 200 solves the system of equations, the controller 200 can determine the position of the draft frame 22 relative to the main frame 18 based on the approximated solution to the system of equations. The method described herein enables the position of the draft frame 22 to be determined in all three rotational directions, including the roll direction, the pitch direction, and the yaw direction. The yaw direction is generally more complicated to determine than the roll and pitch directions.

Furthermore, once the controller 200 determines the position of the draft frame 22, the controller 200 may additionally determine a position of the blade 20. As described in greater detail above, the blade 20 is moveable relative to the draft frame 22 by the circle frame 24, the tilt frame 28, and the blade 20 circle side-shift cylinder 34. Accordingly once the position of the draft frame 22 is known, the controller 200 can determine the position of the blade 20 based on information relating to these operational frames 70.

For example, in some embodiments, the controller 200 determines a position of the blade 20 based, in part, on information sensed by the fourth sensor 132 located on the circle frame 24. The fourth sensor 132 configured to sense a parameter related to rotational movement of the circle frame 24 relative to the main frame 18 and transmit the parameter to the controller 200. The controller 200 is, in turn, configured to determine the position of the blade 20. Additionally, in some embodiments, the controller 200 determines a position of the blade 20 based, in part, on information related to the orientation of the tilt frame 28. For example, the controller 200 may be configured to receive information from a sensor 112 on the tilt frame 28. The controller 200 also be configured to determine an orientation of the tilt frame 28 based on the length of the tilt cylinder 29. Similarly, the controller 200 may determine a position of the blade 20 based, in part, on the length of the blade side-shift cylinder 36.

Additionally, in some embodiments, the controller 200 determines a position of the draft frame 22 based, in part, on information sensed by the fifth sensor 136 located on the main frame 18 or the sixed sensor 112 located downstream of the main frame 18 (or a combination of both). As previously mentioned, the fifth sensor 136 may be an inertial sensor 112 that provides a reference to gravity. The fifth sensor 136 can be configured to measure the roll and pitch of the motor grader 10 as a whole main frame 18, and then the cylinders 50 sensors 112 can be used to determine the movement of the draft frame 22 relative to the main frame 18. In addition, the sixth sensor, which positioned downstream of the main frame 18, for example, on the draft frame 22, circle frame 24, or tilt frame 28, may be used to sense movement or looseness between the main frame 18 and the draft frame 22 (or circle frame 24 or tilt frame 28 depending on the location of the sixth sensor). The controller 200 can compare information sensed by the fifth sensor 136 and the sixth sensor 140 to identify relative movement between the fifth and sixth sensors 112, and thus, relative movement between the main frame 18 and the draft frame 22.

Accordingly, the system and method described herein provides for the ability to track three degrees of freedom of the draft frame 22, including roll, pitch, and yaw. On the other hand, many similar systems are only able to track roll and pitch. Additionally, the system and method described herein enables an operator to operate the machine while the machine is articulated, and also enables an operator to position the blade 20 when the draft frame 22 is in a non-standard position (i.e., a position that is not square with the main frame 18 or the direction of travel).

Figure 13:
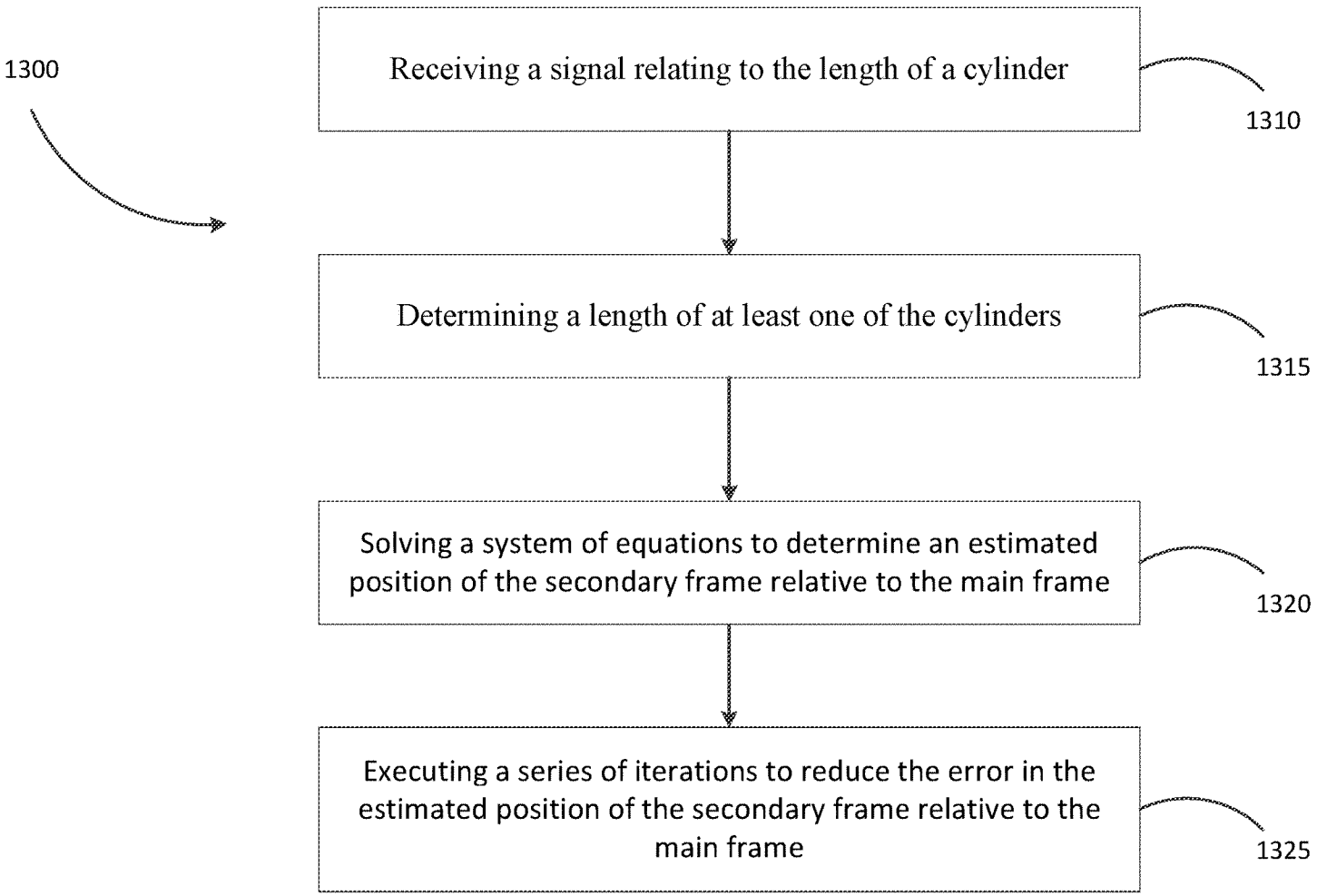
FIG. 13 is a flow chart of a system and method of tracking the position of secondary frame relative to a main frame according to a second embodiment.

FIG. 13 provides another system and method 1300 of tracking the position of the draft frame 22 and/or blade 20 using the cylinder 50 positions, which addresses the complications associated with the number of degrees of freedom and the parallel linkage arrangement of the cylinders 50. The method 1300 of FIG. 13 can be carried out by the controller 200 or one or more processors. In some embodiments, the steps in the method 1300 may be conducted automatically, without user input. In other embodiments, one or more of the steps may require user input or a user to initiate a step. The method 1300 illustrated in FIG. 13 utilizes an iterative method without the use of vector loops to determine the position of the draft frame 22. Specifically, the method 1300 reduces number of degrees of freedom by making assumptions about the movement of the cylinders 50.

FIG. 13 provides method 1300 of tracking movement of a motor grader 10, where the motor grader 10 includes a main frame 18, an operational frame 70 configured to move relative to the main frame 18, and a linkage system 144 coupling the operational frame 70 to the main frame 18. As used herein, the operational frame 70 refers to any one of, or combination of, the blade 20, the draft frame 22, the circle frame 24, and the tilt frame 28. The linkage system 144 includes a plurality of cylinders 50 that are moveable between an extended position and a retracted position to adjust the length of the cylinder 50.

The method 1300 includes receiving, by the controller 200, a signal from one of the cylinder sensors 116 corresponding to a parameter related to a length of the first cylinder 50 (Step 1310). For example, the signal received by the controller 200 may be indicative of the linear position measured by the cylinder sensor 116, or may be indicative of the amount of fluid flowing through the cylinder 50. Based on the signal received from the cylinder sensor 116, the controller 200 determines a length of at least one of the cylinders 50 (Step 1315). For example, the controller 200 may calculate the length of the cylinder 50 based on the linear position of the sensor 112 of the amount and direction of fluid flowing through the cylinder 50. The method 1300 also includes solving a system of equations to determine an estimated position of the operational frame 70 relative to the main frame 18 (Step 1320). For example, the system of equations may be the simplified system of equations described above. The method 1300 further includes executing an iterative method to reduce the error in the estimated position of the operational frame 70 relative to the main frame 18 and establish an updated estimated position of the operational frame 70 relative to the main frame 18 (1325).

In one embodiment, the steps 1320 and 1325 of determining the position of the operational frame 70 relative to the main frame 18 may include a calculation that uses a Newton-Raphson solution of a kinematic model (i.e., a system of equations) of the orientation of the operational frame 70 relative to the main frame 18. The solution starts with an estimate (or guess) of the orientation of the operational frame 70 that would satisfy the constraints of the system of equations (Step 1320). The controller 200 then calculates the constraint errors (or residual). Using the calculated constraint errors, the controller 200 determines an updated (i.e., more accurate) estimate of the orientation of the operational frame 70 relative to the main frame 18. For example, the controller 200 may calculate an adjustment of the estimated position of the operational frame 70 by solving a set of linear equations to update the orientation estimate. The controller 200 repeats the step of calculating the constraint errors and adjusting the estimated position (i.e., executes a series of iterations). Each time the controller 200 repeats these steps, the estimate of the orientation of the operational frame 70 is improved.

Typical iterative methods continue to repeat until the error calculation falls below a predetermined threshold. In the method 1300 illustrated in FIG. 13, the controller 200 executes a fixed number of iterations per time step to limit the computational time and avoid stalling of the machine. In some embodiments of the method 1300, the controller 200 executes iterations until the error calculation falls below a predetermined threshold upon start up of the motor grader 10, and then executes a fixed number of iterations per time step after start up.

Figure 14:
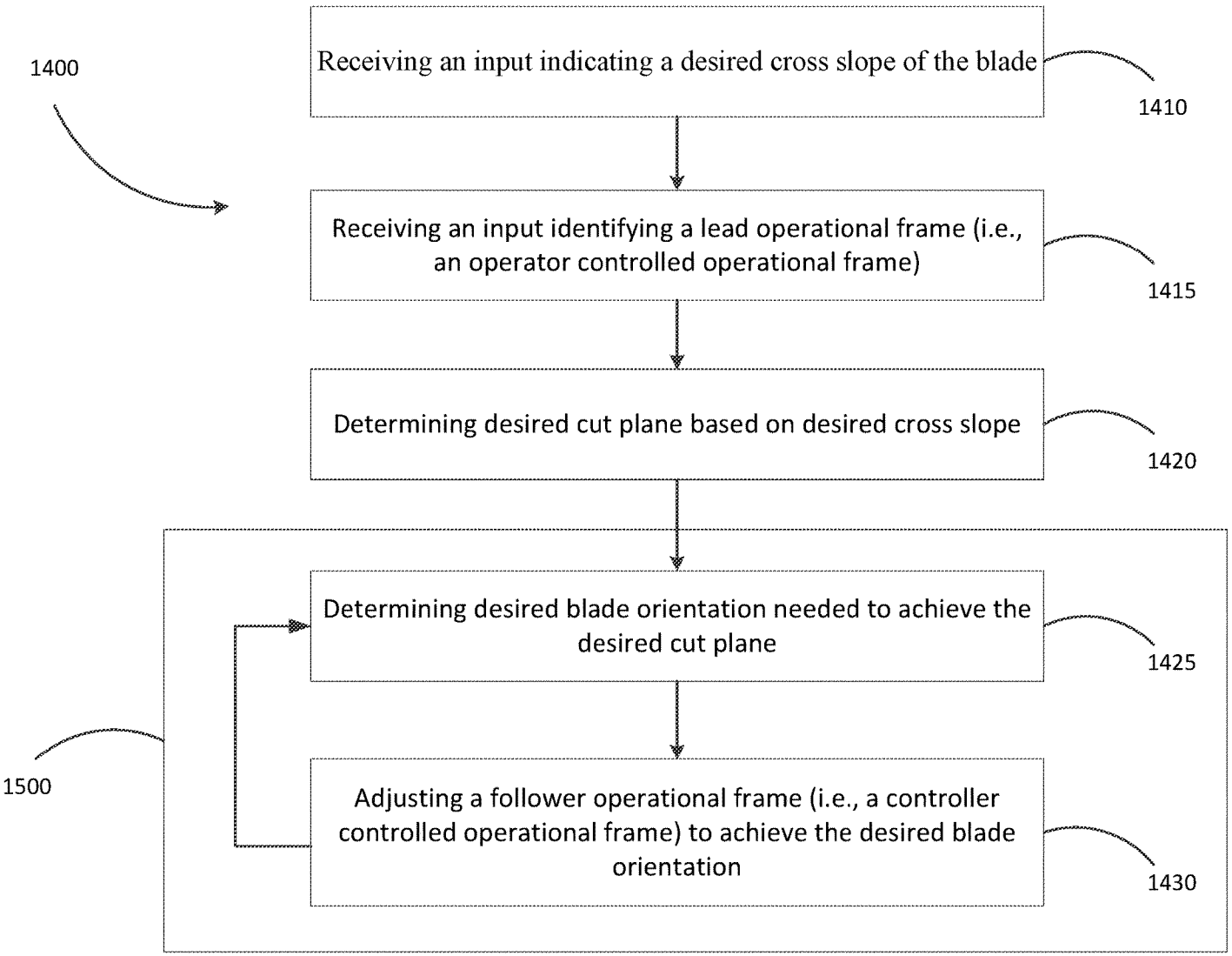
FIG. 14 is a flow chart of method of monitoring and controlling a position of an operational frame of a motor grader according to one embodiment.

The methods 800 and 1300 described above can be a sub-method that is part of a larger method of controlling and/or monitoring the position and movement of an operational frame 70 of a motor grader 10 relative to the main frame 18 of the motor grader 10. FIG. 14 illustrates one embodiment of a method 1400 of controlling the blade 20 of a motor grader 10. As discussed above, the orientation of the blade 20 can be affected by several operational frames 70 (i.e., the draft frame 22, the circle frame 24, and the tilt frame 28), which each controls a different direction of movement and/or rotation of the blade 20. Therefore, controlling the blade 20 can be a complex task, which requires an operator to operate one or more of the draft frame 22, the circle frame 24, and the tilt frame 28 in order to position and move the blade 20.

Accordingly, the method 1400 allows an operator to choose a desired cross slope (or cut angle) of the blade 20 and instruct the controller 200 to maintain the desired cross slope of the blade 20. The controller 200 can maintain the desired cross slope of the blade 20 while the operator at least partially controls one of the operational frames 70 of the motor grader 10. As one example, the operator may control one of the operational frames 70, for example, to lift or drop the height of the blade 20. The operator may also drive the motor grader 10 along a travel direction. In response to the operator controlling these aspects of the motor grader 10, the controller 200 can adjust the orientation of the blade 20 relative to the main frame 18 in order to maintain a desired cross slope angle despite other moving components of the motor grader 10.

In the illustrated method 1400, the controller 200 maintains the desired cross slope of the blade 20 in response to the operator controlling either the left lift cylinder 52 or the right lift cylinder 56 to at least partially control the draft frame 22. The controller 200 then maintains the position of the blade 20 to achieve the desired cross slope by controlling the lift cylinder 5 that is not being controlled by the operator (i.e., the left lift cylinder 52 or the right lift cylinder 56). However, it should be understood by a personal of ordinary skill in the art that in other embodiments, method 1400 may involve the controller 200 maintaining the desired cross slope of the blade 20 while the operator controls a different operational frame 70 (e.g., the circle frame 24 or the tilt frame 28). The method 1400 can be carried out by the controller 200 or one or more processor. In some embodiments, the steps in the method 1400 may be conducted automatically, without user input. In other embodiments, one or more of the steps may require user input or a user to initiate a step.

Referring to FIG. 14, the method 1400 includes receiving, by the controller 200, an input indicating a desired cross slope of the blade 20 (Step 1410). The cross slope is defined as the angle between the global z-axis (or global "up" direction). The global z-axis can be determined by an inertial measurement unit (IMU) positioned on the motor grader 10. For example, in some embodiments, the global z-axis can be determined by the fifth sensor 136, as described above.

The controller 200 also receives an input identifying an operator controlled operational frame 70 (or "lead operational frame") (Step 1415). In some embodiments, the operator inputs a signal to the controller 200 (e.g., via a user interface 214) indicating which operational frame 70 is being controlled by the operator. In other embodiments, the operator does not need to input a designated lead operational frame, but rather, the controller 200 determines which operational frame 70 is being controlled by the operator based on a sensor 112 or other system characteristic (e.g., power, voltage, movement, etc.) of the operational frame. By identifying an operator controlled operational frame, the controller 200 can determine which operational frames 70 are being manually controlled by the operator and which operational frames 70 may be automatically controlled by the controller 200.

In some embodiments, the lead operational frame 70*a* may be an operational frame 70 controlled entirely by the operator, while in other embodiments, the lead operational frame 70*a* may only be partially controlled by the operator. For example, in the illustrated embodiment, the draft frame 22 is partially manually controlled by the operator and partially automatically controlled by the controller 200. The operator may send a signal to the controller 200 designating either the left lift cylinder 52 or the right lift cylinder 56 as the operator controlled cylinder 50. As will be described in greater detail below, the controller 200 can then automatically control the other of the left lift cylinder 52 and the right lift cylinder 56 that is not being controlled by the operator. As used herein, the operator controlled operational frame 70 may be referred to as the "lead operational frame" and the controller 200 controlled operational frame 70 may be referred to as the "follower operational frame." Similarly, in situations where the operator and the controller 200 share control of an operational frame 70 (e.g., the draft frame 22), the operator controlled cylinder 50 may be referred to as the "lead cylinder 50*a*" and the controller 200 controlled cylinder 50 may be referred to as the "follower cylinder 50*b*."

The method 1400 also includes determining a desired cut plane based, at least in part, on the desired cut slope (Step 1420). The desired cut slope indicates a desired angle of the blade 20. However, when the motor grader 10 moves across a surface, the blade 20 will define both an angle and a trajectory, which together form a cut plane. In other words, the cut plane is created by sweeping 80 the blade 20 along the travel direction at the desired cross slope. The cut plane is determined based on the desired cross slope, the direction of travel of the motor grader 10, and the global z-axis. The direction of travel accounts for both the steering of motor grader 10, as well as the articulation angle of the motor grader 10.

The method 1400 further includes the controller 200 executing a kinematic calculation of the desired blade orientation needed to achieve the desired cut plane (Step 1425). Specifically, the controller 200 determines the desired blade orientation based, at least in part, on the desired cross slope and the position of the lead operational frame 70*a* controlled by the operator. In other words, the controller 200 determines the desired blade orientation while holding the blade edge and the position of the lead operational frame 70*a* (or at least the lead cylinder 50*a*) as fixed values, or constraints. The controller 200 can then determine what position the follower operational frame 70*b* should be in in order to maintain the desired cross slope.

In order to determine the desired blade orientation needed to achieve the desired cut plane, the controller 200 can use one of the methods 800, 1300 described above. For example, the controller 200 may utilize the systems of equations and the iterative methods of solving the systems of equations described above. Specifically, the controller 200 utilizes the methods above in order to determine the orientations of the operational frames 70 needed to achieve the desired cross slope given, among other things, the current length of the lead cylinder 50*a* controlled by the operator. In some embodiments, the iterative method utilizes vector loops to establish the system of equations used in the iterative method. In other embodiments, the iterative method uses a simplified system of equations that reduces the number of degrees of freedom.

In the illustrated embodiment, the determination of the desired blade orientation includes determining the orientation of the operational frames 70 relative to the main frame 18. This may also involve determining the current lengths of the cylinders 50 and the lengths of the cylinders 50 needed to achieve the orientation of the operational frames 70 that result in the desired blade orientation. For example, the calculation of the desired blade orientation may involve determining the current lengths of the left and right lift cylinders 52, 56, the circle side-shift cylinder 34, the rotation of the circle frame 24, and the like. As described above, the controller 200 can communicate with the sensors 112 on the motor grader 10 (e.g., the cylinder sensors 116, the sensor 132 on the circle frame 24, etc.) to determine the current lengths of the cylinders 50, and thus, the position of the operational frames 70 needed to create the desired cross slope.

In the illustrated embodiment, the controller 200 receives signals from the sensors 112. Based at least in part on the information from the sensors 112, the controller 200 executes a kinematic calculation of the desired blade orientation given the following variables: 1) the length of the lead cylinder 50*a* (i.e., the operator controlled lift cylinder), 2) the length of the circle side-shift cylinder 34) the angle of the circle frame 24 relative to the draft frame 22, and 4) the position of the saddle 30. These variables can be determined from information sensed by the cylinder sensors 116, the sensor 112 on the circle frame 24, and/or internal measurements such as the amount fluid flowing through a cylinder, as discussed herein.

In addition, the determination of the desired blade orientation may be continuously re-calculated in order to maintain the desired cross slope of the blade 20. More specifically, when the operator adjusts one of the operational frames 70 of the motor grader 10, the desired orientation of the blade 20 may change due the change in the orientation of the operational frame. For example, the operator may be controlling the lead cylinder 50*a* (e.g., the right lift cylinder 56 or left lift cylinder 52), which adjusts the position of the draft frame 22. When the draft frame 22 is reoriented to a new position, the other operational frames 70, such as the blade 20, may also be adjusted to a new position. Therefore, the controller 200 re-calculates the desired blade orientation needed to achieve the desired cross slope previously designated by the operator. Similarly, the operator may adjust the circle frame 24, which would also trigger the controller 200 to re-calculate the desired blade orientation needed to achieve the desired cross slope.

Once the controller 200 determines the desired blade orientation needed to achieve the desired cut plane (Step 1425), the controller 200 adjusts the blade 20 from the current blade orientation to the desired blade orientation (Step 1430). The controller 200 continuously adjusts the current blade orientation to attempt to maintain the desired cross slope of the blade 20 designated by the operator of the motor grader 10. Specifically, the controller 200 adjusts the blade 20 by monitoring the lead operational frame 70*a* and then controlling the follower operational frame 70*b* to adjust the position of the blade 20 towards the desired blade orientation.

As shown in FIG. 14, the step of determining the desired blade orientation (Step 1425) and the step of adjusting the blade 20 to achieve the desired blade orientation (Step 1430) may be cyclical. In addition, some aspects of the step of determining the desired blade orientation (Step 1425) and the step of adjusting the blade 20 to achieve the desired blade orientation (Step 1430) may overlap or be part of both steps. For example, the controller 200 may communicate with the sensors 112 to receive information about the lengths of the cylinders 50 and the angle of rotation of the circle frame 24 both for the purpose of determining the desired blade orientation (Step 1425) and for the purpose of adjusting the blade 20 to achieve the desired blade orientation (Step 1430). Similarly, controlling the follower operational frame 70*b* to achieve the desired blade orientation may include re-calculating a desired position of the follower operational frame 70*b* based on a re-calculated desired blade orientation.

Figure 15:
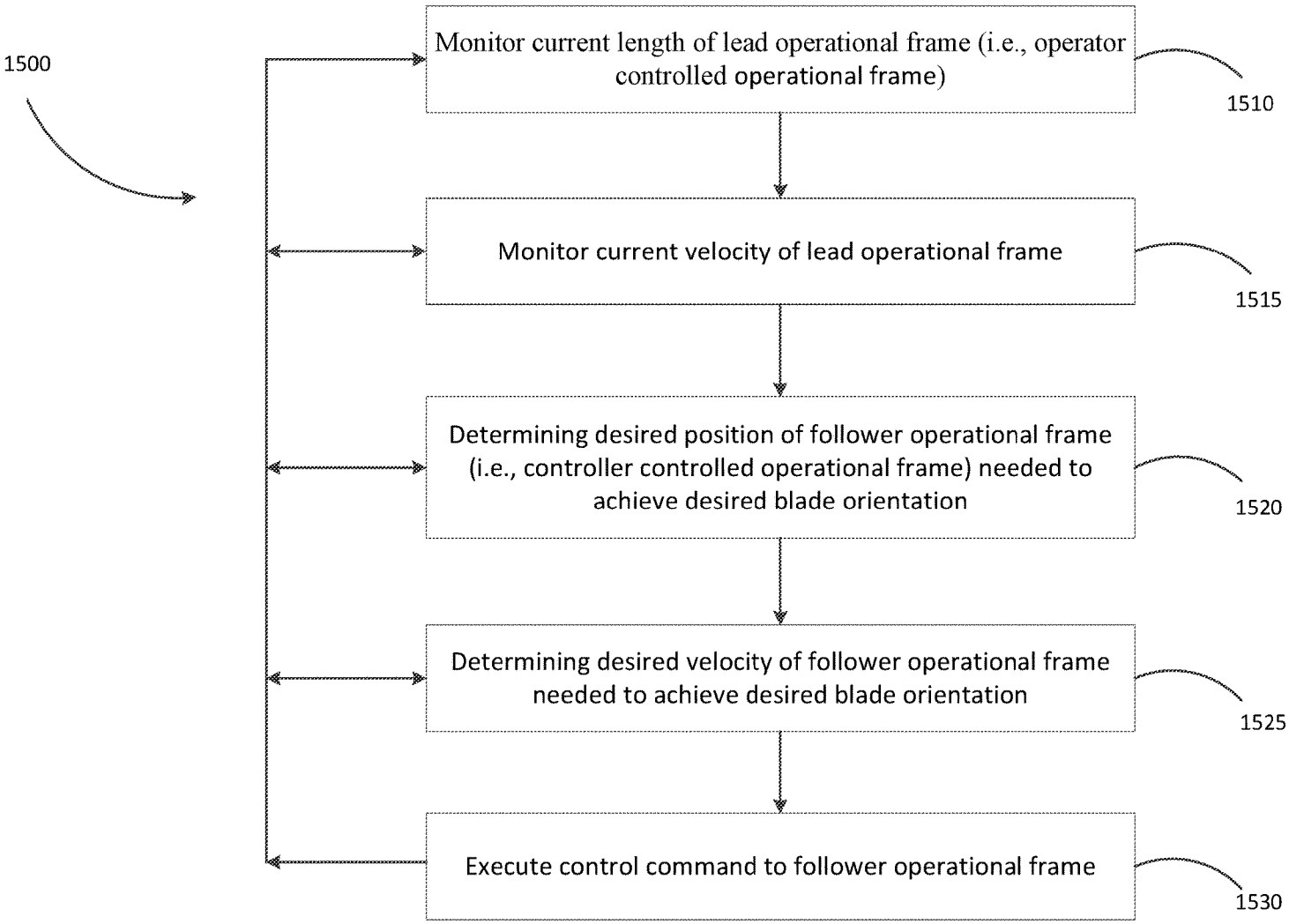
FIG. 15 is a flow chart of method of adjusting a position of an operational frame of a motor grader according to one embodiment.

FIG. 15 illustrates one embodiment of a method 1500 of adjusting the blade 20 to achieve the desired blade orientation. The method 1500 illustrated in FIG. 15 is described in terms of controlling the draft frame 22 to adjust the blade 20 to achieve the desired blade orientation. Specifically, in the illustrated embodiment, the draft frame 22 is partially manually controlled by the operator and partially automatically controlled by the controller 200. The operator controls one of the left and right lift cylinders 52, 56 of the draft frame 22 (i.e., the lead cylinder 50*a*) and the controller 200 operates another one of the left and right lift cylinders 52, 56 of the draft frame 22 (i.e., the follower cylinder 50*b*). However, it should be understood that in other embodiments the controller 200 can be configured to control other operational frames 70 to adjust the blade 20 to achieve the desired blade orientation. For example, the controller 200 may be configured to control the circle frame 24 in response to the operator controlling the draft frame 22.

With continued reference to FIG. 15, the controller 200 monitors the current position of the lead operational frame 70*a* (Step 510). In the illustrated embodiment, the controller 200 monitors, among other things, the length of the lead cylinder 50*a* to determine a position of the draft frame 22 (Step 1510). The controller 200 can monitor the length of the lead cylinder 50*a* by communicating with the cylinder sensor 116 corresponding to the lead cylinder 50*a*. In the illustrated embodiment, the lead cylinder 50*a* is either the left lift cylinder 52 or the right lift cylinder 56, whichever is being controlled by the operator.

The controller 200 also monitors the velocity of the lead operational frame 70*a* (Step 1515). In the illustrated embodiment, the controller 200 monitors the velocity of the lead cylinder 50*a*. The velocity of a cylinder 50 refers to the rate at which the cylinder length is changing. The controller 200 can determine the velocity of the lead cylinder 50*a* by communicating with the cylinder sensors 116. For example, the controller 200 can communicate with a cylinder sensor 116 to determine the change in measured cylinder position (i.e., cylinder length) sensed by the cylinder sensors 116. In addition, or alternatively, the controller 200 can determine the velocity of the lead cylinder 50*a* via the operator commands rather than the measured values from the cylinder sensors 116. In the illustrated embodiment the controller 200 determines the velocity of the lead cylinder 50*a* by fusing the change in measured position sensed by the cylinder sensor 116 and the operator commands.

Some of the information monitored in Steps 1510 and 1515 can be used to determine the desired blade orientation described in Step 1425. As previously mentioned, Steps 1425 and 1430 are cyclical and may overlap.

In addition, the controller 200 calculates a desired position of the follower operational frame 70*b* (Step 1520). In the illustrated embodiment, the controller 200 calculates a desired length of the follower cylinder 50*b* based on the desired blade orientation (Step 1520). The follower cylinder

50*b* is either the left lift cylinder 52 or the right lift cylinder 56, whichever is not being controlled by the operator.

The controller 200 also calculates a desired velocity of the follower operational frame 70*b* (Step 1525). In the illustrated embodiment, the controller 200 calculates the desired velocity of the follower cylinder 50*b* (Step 1525). The desired velocity of the follower cylinder 50*b* accounts for the velocity of the lead cylinder 50*a* and a desire to move the draft frame 22 smoothly. When the lead cylinder 50*a* is moving at a higher velocity, it is desirable for the follower cylinder 50*b* to match the velocity of the lead cylinder 50*a* in order to maintain the position of the blade 20 at the desired cross slope. In addition, when the controller 200 adjusts the follower cylinder 50*b*, it is not desirable for the draft frame 22 to jerk due to the rate at which the follower cylinder 50*b* is moving (i.e., changing length) to reposition the draft frame 22. Accordingly, the desired velocity of the follower cylinder 50*b* accounts for both the desire to match the velocity of the lead cylinder 50*a* while also adjusting the draft frame 22 in a smooth matter so as to prevent jerking.

Once the controller 200 has determined a desired position and velocity of the follower operational frame 70*b*, the controller 200 executes a command to move the follower operational frame 70*b* in order to achieve or maintain the desired blade 20 position resulting in the desired cross slope (Step 1530). More specifically, the controller 200 executes a valve command to one of the cylinders associated with the follower operational frame 70*b* regarding the rate of flow of hydraulic fluid to or from the cylinder. In the illustrated embodiment, the controller 200 executes a valve command to the follower cylinder 50*b* to achieve the desired length and velocity (Step 1530). For example, the controller 200 executes a vavle command to the follower cylinder 50*b* to control the rate of flow (i.e., volume per time) of hydraulic fluid to or from the follower cylinder 50 to achieve the desired length of the follower cylinder 50*b*.

In some embodiments, the valve command may include a feedforward control and a feedback correction. Specifically, the valve command may be a combination of a feedforward command adjusted based on a feedback correction. The feedforward portion of the valve command is based on the calculated desired velocity, which is an estimate of the anticipated velocity. The feedback portion of the valve command is based on position error and velocity error. The position error is determined by the difference between the desired position and the measured position (i.e., measured by the sensors). Similarly, the velocity error is determined by the difference between the desired velocity and the measured velocity (i.e., measured by the sensors).

The controller 200 repeats the steps of method 1500 to continue to adjust the operational frames 70 to achieve and maintain the desired cross slope of the blade 20. As previously mentioned, the controller 200 also repeats the steps of determining the desired blade orientation needed to achieve the desired cut plane (Step 1425), and adjusting the blade 20 from the current blade orientation to the desired blade orientation (Step 1430). More specifically, the controller 200 continuously determines the desired blade orientation based on the desired cross slope indicated by the operator and the operator controlling at least one operational frame 70. The controller 200 then continuously adjusts the operational frames 70 that are not being controlled by the operator to achieve or maintain the desired blade orientation that results in the desired cross slope.

Accordingly, provided herein is a system and method of controlling a motor grader 10 to maintain a desired cross slope indicated by an operator. Also provided herein is a system and method of determining a position of a draft frame 22 of a motor grader 10. Although the disclosure has been described in detail with reference to certain preferred embodiments, variations and modifications exist within the scope and spirit of one or more independent aspects of the disclosure as described. Various features and advantages of the disclosure are set forth in the following claims.

What is claimed is:

1. A motor grader, comprising:

a main frame;

an operational frame movable relative to the main frame about a primary joint;

a plurality of hydraulic cylinders configured to adjust a position of the operational frame relative to the main frame, each cylinder of the plurality of cylinders movable between an extended position and a retracted position to adjust the length thereof, wherein the plurality of cylinders is operatively connected such that movement of one cylinder of the plurality of cylinders causes movement of at least another cylinder of the plurality of cylinders; and a processor configured to receive a signal corresponding to a parameter related to a length of a first cylinder of the plurality of cylinders, and estimate a position of the operational frame relative to the main frame based at least in part on the length of the first cylinder, wherein the processor estimates the position of the operational frame by executing an iterative mathematical model to solve for the position of the operational frame.

2. The motor grader of claim 1, wherein the processor is further configured to adjust the position of the operational frame by executing a valve command to a second cylinder of the plurality of cylinders.

3. The motor grader of claim 2, wherein the first cylinder is manually controlled by an operator of the motor grader, and wherein the second cylinder is automatically controlled by the processor.

4. The motor grader of claim 2, wherein the processor is further configured to estimate a current velocity of the operational frame.

5. The motor grader of claim 4, wherein the valve command includes instructions to the second cylinder indicating a rate of flow of hydraulic fluid to or from the second cylinder, and wherein the valve command is calculated at least in part on the estimated current velocity.

6. The motor grader of claim 1, wherein the estimated position of the operational frame relative to the main frame includes the estimated position of the operational frame necessary to achieve the desired cut plane.

7. The motor grader of claim 1, wherein the estimated position of the operational frame relative to the main frame includes the current position of the operational frame.

8. The motor grader of claim 1, wherein the processor is further configured to receive a user input indicating a desired cross slope of the operational frame, and wherein processor is configured to adjust the position of the operational frame toward the desired cross slope.

9. The motor grader of claim 1, further comprising a plurality of sensors, wherein each sensor of the plurality of sensors is associated with one cylinder of the plurality of cylinders, each sensor configured to sense a parameter relating to the length of the corresponding cylinder.

10. A motor grader, comprising:

a main frame;

an operational frame movable relative to the main frame about a primary joint;

a plurality of hydraulic cylinders configured to adjust a position of the operational frame relative to the main frame, each cylinder of the plurality of cylinders movable between an extended position and a retracted position to adjust the length thereof; and a processor configured to receive a signal indicating a desired cross slope of the operational frame, receive a signal identifying one of the plurality of cylinders as a lead cylinder, determine a desired position of the operational frame that achieves the desired cross slope of the operational frame, estimate a current position of the operational frame by monitoring a length of the lead cylinder, and adjust the position of the operational frame by controlling a follower cylinder of the plurality of cylinders to create the desired cross slope.

11. The motor grader of claim 10, further comprising a plurality of sensors, wherein each sensor of the plurality of sensors is associated with one cylinder of the plurality of cylinders, each sensor configured to sense a parameter relating to the length of the corresponding cylinder.

12. The motor grader of claim 11, wherein the processor is configured to estimate the current position of the operational frame based at least in part on information sensed by one of the plurality of sensors associated with the lead cylinder.

13. The motor grader of claim 12, wherein the processor is further configured to estimate a velocity of the operational frame based at least in part on information sensed by one of the plurality of sensors associated with the lead cylinder.

14. The motor grader of claim 13, wherein the processor is configured to adjust the position of the operational frame by executing a valve command to the follower cylinder.

15. The motor grader of claim 14, wherein the valve command includes instructions to the follower cylinder indicating a rate of flow of hydraulic fluid to or from the follower cylinder, and wherein the valve command is calculated at least in part on the estimated current velocity.

16. The motor grader of claim 10, wherein the processor is configured to estimate a current position of the operational frame by executing an iterative mathematical model to solve for the estimated position of the operational frame.

17. A motor grader, comprising:

a main frame;

an operational frame movable relative to the main frame about a primary joint;

a plurality of hydraulic cylinders configured to adjust a position of the operational frame relative to the main frame, each cylinder of the plurality of cylinders movable between an extended position and a retracted position to adjust the length thereof;

a plurality of sensors, wherein each sensor of the plurality of sensors is associated with one cylinder of the plurality of cylinders, each sensor configured to sense a parameter relating to the length of the corresponding cylinder; and a processor configured to receive a signal corresponding to a parameter related to a length of a first cylinder of the plurality of cylinders, estimate a position of the operational frame based on the received signal, estimate a velocity of the operational frame based on the received signal, and adjust the operational frame by executing a valve command to a second cylinder of the plurality of cylinders.

18. The motor grader of claim 17, wherein the processor is further configured to receive a signal indicating a desired cross slope of the operational frame, and wherein the processor is configured to adjust the operational frame to achieve the desired cross slope.

19. The motor grader of claim 17, wherein the valve command indicates a velocity and an amount of hydraulic fluid to be fed through a second cylinder.

20. The motor grader of claim 19, wherein the valve command is based at least in part on the estimated position and the estimated velocity of the operational frame.

21. The motor grader of claim 17, wherein the plurality of cylinders is operatively connected such that movement of one cylinder of the plurality of cylinders causes movement of at least another cylinder of the plurality of cylinders.

22. The motor grader of claim 21, wherein the processor is configured to estimate the position of the operational frame by executing an iterative mathematical model to solve for the position of the operational frame.

* * * * *